US009899196B1

(12) United States Patent
Cody

(10) Patent No.: US 9,899,196 B1
(45) Date of Patent: Feb. 20, 2018

(54) DOPANT-ASSISTED DIRECT ANALYSIS IN REAL TIME MASS SPECTROMETRY

(71) Applicant: JEOL USA, INC, Peabody, MA (US)

(72) Inventor: Robert B. Cody, Portsmouth, NH (US)

(73) Assignee: JEOL USA, INC., Peabody, MA (US)

( * ) Notice: Subject to any disclaimer, the term of this patent is extended or adjusted under 35 U.S.C. 154(b) by 0 days.

(21) Appl. No.: 15/403,108

(22) Filed: Jan. 10, 2017

Related U.S. Application Data

(60) Provisional application No. 62/277,826, filed on Jan. 12, 2016.

(51) Int. Cl.
*H01J 49/00* (2006.01)

(52) U.S. Cl.
CPC ..... *H01J 49/0031* (2013.01); *H01J 49/0045* (2013.01)

(58) Field of Classification Search
CPC .... H01J 49/00; H01J 49/0454; H01J 49/0027; H01J 49/02; H01J 49/0431
USPC ..... 250/281, 282, 285, 288
See application file for complete search history.

(56) References Cited

U.S. PATENT DOCUMENTS

| | | | |
|---|---|---|---|
| 3,633,027 | A | 1/1972 | Rhyage |
| 3,957,470 | A | 5/1976 | Dawes |
| 4,016,421 | A | 4/1977 | Hull |
| 4,144,451 | A | 3/1979 | Kambara |
| 4,213,326 | A | 7/1980 | Brodasky |
| 4,542,293 | A | 9/1985 | Fenn |
| 4,546,253 | A | 10/1985 | Tsuchiya |
| 4,654,052 | A | 3/1987 | Sharp |
| 4,662,914 | A | 5/1987 | Hansen |
| 4,861,988 | A | 8/1989 | Henion |
| 5,012,052 | A | 4/1991 | Hayes |
| 5,055,677 | A | 10/1991 | Amirav |
| 5,137,553 | A | 8/1992 | Dawes |
| 5,192,865 | A | 3/1993 | Zhu |
| 5,306,412 | A | 4/1994 | Whitehouse |

(Continued)

FOREIGN PATENT DOCUMENTS

| | | |
|---|---|---|
| GB | 2263578 | 7/1993 |
| JP | 2003185635 | 7/2003 |

(Continued)

OTHER PUBLICATIONS

The AccuTOF-DART Mass Spectrometer, Jan. 1, 2006, pp. 1-6; www.jeolusa.com/SERVICESUPPORT/ApplicationsResources/AnalyticalInstruments/Documents/Downloads/tabid/337/DMXModule/693/CommandCore_Download/Default.aspx?EntryId=171.

(Continued)

*Primary Examiner* — Jason McCormack
(74) *Attorney, Agent, or Firm* — SCI-LAW Strategies, PC

(57) ABSTRACT

The present invention is directed to a method of Direct Analysis in Real Time (DART) analysis with a carrier gas in the addition of an efficient dopant to the carrier gas stream exiting the DART source. Charge-exchange and proton transfer reactions are observed with the addition of dopants such as toluene, anisole, and acetone. The argon DART mass spectrum in the presence of an efficient dopant was dominated by molecular ions for aromatic compounds, whereas the helium DART mass spectrum of the same aromatic showed both molecular ions and protonated molecule species. Fragment ions generated from analysis with argon gas in the presence of an efficient dopant can be used to distinguish isobaric analytes.

21 Claims, 27 Drawing Sheets

(56) References Cited

U.S. PATENT DOCUMENTS

| | | | |
|---|---|---|---|
| 5,352,892 | A | 10/1994 | Mordehai |
| 5,367,163 | A | 11/1994 | Otsuka |
| 5,381,008 | A | 1/1995 | Tanner |
| 5,412,208 | A | 5/1995 | Covey |
| 5,448,062 | A | 9/1995 | Cooks |
| 5,552,599 | A | 9/1996 | Giessmann |
| 5,559,326 | A | 9/1996 | Goodley |
| 5,614,711 | A | 3/1997 | Li |
| 5,624,537 | A | 4/1997 | Turner |
| 5,684,300 | A | 11/1997 | Taylor |
| 5,716,825 | A | 2/1998 | Hancock |
| 5,736,741 | A | 4/1998 | Bertsch |
| 5,788,166 | A | 8/1998 | Valaskovic |
| 5,859,433 | A | 1/1999 | Franzen |
| 5,868,322 | A | 2/1999 | Loucks, Jr. |
| 5,889,404 | A | 3/1999 | Abdel |
| 5,959,297 | A | 9/1999 | Weinberg |
| 5,997,746 | A | 12/1999 | Valaskovic |
| 6,107,628 | A | 8/2000 | Smith |
| 6,124,675 | A | 9/2000 | Betrand |
| 6,190,559 | B1 | 2/2001 | Valaskovic |
| 6,225,623 | B1 | 5/2001 | Turner |
| 6,297,499 | B1 | 10/2001 | Fenn |
| 6,359,275 | B1 | 3/2002 | Bertsch |
| 6,395,183 | B1 | 5/2002 | Valaskovic |
| 6,562,211 | B1 | 5/2003 | Kunnecke |
| 6,583,408 | B2 | 6/2003 | Smith |
| 6,600,155 | B1 | 7/2003 | Andrien, Jr. |
| 6,646,256 | B2 | 11/2003 | Gourley |
| 6,649,907 | B2 | 11/2003 | Ebeling |
| 6,670,608 | B1 | 12/2003 | Taylor |
| 6,690,006 | B2 | 2/2004 | Valaskovic |
| 6,713,757 | B2 | 3/2004 | Tanner |
| 6,717,139 | B2 | 4/2004 | Taniguchi |
| 6,723,985 | B2 | 4/2004 | Schultz |
| 6,744,041 | B2 | 6/2004 | Sheehan |
| 6,744,046 | B2 | 6/2004 | Valaskovic |
| 6,753,523 | B1 | 6/2004 | Whitehouse |
| 6,784,424 | B1 | 8/2004 | Willoughby |
| 6,794,642 | B2 | 9/2004 | Bateman |
| 6,803,565 | B2 | 10/2004 | Smith |
| 6,806,468 | B2 | 10/2004 | Laiko |
| 6,818,889 | B1 | 11/2004 | Sheehan |
| 6,861,647 | B2 | 3/2005 | Reilly |
| 6,875,980 | B2 | 4/2005 | Bateman |
| 6,878,930 | B1 | 4/2005 | Willoughby |
| 6,888,132 | B1 | 5/2005 | Sheehan |
| 6,914,243 | B2 | 7/2005 | Sheehan |
| 6,943,347 | B1 | 9/2005 | Willoughby |
| 6,949,739 | B2 | 9/2005 | Franzen |
| 6,949,740 | B1 | 9/2005 | Sheehan |
| 6,949,741 | B2 | 9/2005 | Cody |
| 6,956,205 | B2 | 10/2005 | Park |
| 6,977,372 | B2 | 12/2005 | Valaskovic |
| 6,979,816 | B2 | 12/2005 | Tang |
| 6,987,264 | B1 | 1/2006 | Whitehouse |
| 6,992,299 | B2 | 1/2006 | Lee |
| 7,015,466 | B2 | 3/2006 | Takats |
| 7,019,289 | B2 | 3/2006 | Wang |
| 7,034,292 | B1 | 4/2006 | Whitehouse |
| 7,041,972 | B2 | 5/2006 | Bajic |
| 7,049,584 | B1 | 5/2006 | Whitehouse |
| 7,053,368 | B2 | 5/2006 | Thakur |
| 7,064,317 | B2 | 6/2006 | McCluckey |
| 7,071,464 | B2 | 7/2006 | Reinhold |
| 7,081,618 | B2 | 7/2006 | Laprade |
| 7,081,621 | B1 | 7/2006 | Willoughby |
| 7,095,019 | B1 | 8/2006 | Sheehan |
| 7,098,452 | B2 | 8/2006 | Schneider |
| 7,112,785 | B2 | 9/2006 | Laramee |
| 7,138,626 | B1 | 11/2006 | Karpetsky |
| 7,157,698 | B2 | 1/2007 | Makarov |
| 7,161,145 | B2 | 1/2007 | Oser |
| 7,196,525 | B2 | 3/2007 | Sparkman |
| 7,247,495 | B2 | 7/2007 | Amirav |
| 7,253,406 | B1 | 8/2007 | Sheehan |
| 7,332,345 | B2 | 2/2008 | Darrach |
| 7,423,261 | B2 | 9/2008 | Truche |
| 7,429,731 | B1 | 9/2008 | Karpetsky |
| 7,462,826 | B2 | 12/2008 | Schneider |
| 7,544,933 | B2 | 6/2009 | Cooks |
| 7,569,812 | B1 | 8/2009 | Karpetsky |
| 7,582,864 | B2 | 9/2009 | Verentchikov |
| 7,700,913 | B2 | 4/2010 | Musselman |
| 7,705,297 | B2 | 4/2010 | Musselman |
| 7,714,281 | B2 | 5/2010 | Musselman |
| 7,777,181 | B2 | 8/2010 | Musselman |
| 7,858,926 | B1 | 12/2010 | Whitehouse |
| 7,893,408 | B2 | 2/2011 | Hieftje |
| 7,915,579 | B2 | 3/2011 | Chen |
| 7,923,681 | B2 | 4/2011 | Collings |
| 7,928,364 | B2 | 4/2011 | Musselman |
| 7,929,138 | B1 | 4/2011 | Webb |
| 7,982,183 | B2 | 7/2011 | Marakov |
| 7,982,185 | B2 | 7/2011 | Whitehouse |
| 8,003,935 | B2 | 8/2011 | Robinson |
| 8,026,477 | B2 | 9/2011 | Musselman |
| 8,044,346 | B2 | 10/2011 | Kostiainen |
| RE43,078 | E | 1/2012 | Cody |
| 8,101,910 | B2 | 1/2012 | Loboda |
| 8,207,497 | B2 | 6/2012 | Musselman |
| 8,217,341 | B2 | 7/2012 | Musselman |
| 8,242,459 | B2 | 8/2012 | Sun |
| 8,278,619 | B2 | 10/2012 | Makarov |
| 8,304,718 | B2 | 11/2012 | Ouyang |
| 8,308,339 | B2 | 11/2012 | Karpetsky |
| 8,334,507 | B1 | 12/2012 | Whitehouse |
| 8,362,418 | B2 | 1/2013 | Xu |
| 8,410,431 | B2 | 4/2013 | Ouyang |
| 8,421,005 | B2 | 4/2013 | Musselman |
| 8,440,965 | B2 | 5/2013 | Musselman |
| 8,481,922 | B2 | 7/2013 | Musselman |
| 8,497,474 | B2 | 7/2013 | Musselman |
| 8,519,354 | B2 | 8/2013 | Charipar |
| 8,525,109 | B2 | 9/2013 | Musselman |
| 8,563,945 | B2 | 10/2013 | Musselman |
| RE44,603 | E | 11/2013 | Cody |
| 8,592,756 | B2 | 11/2013 | Ouyang |
| 8,592,758 | B1 | 11/2013 | Nilles |
| 8,604,423 | B2 | 12/2013 | Enke |
| 8,648,295 | B2 | 2/2014 | Enke |
| 8,664,000 | B2 | 3/2014 | Yang |
| 8,686,351 | B2 | 4/2014 | Ouyang |
| 8,704,167 | B2 | 4/2014 | Cooks |
| 8,710,437 | B2 | 4/2014 | Cooks |
| 8,729,496 | B2 | 5/2014 | Musselman |
| 8,754,365 | B2 | 6/2014 | Krechmer |
| 8,766,178 | B2 | 7/2014 | Ouyang |
| 8,803,085 | B2 | 8/2014 | Ouyang |
| 8,816,275 | B2 | 8/2014 | Ouyang |
| 8,822,949 | B2 | 9/2014 | Musselman |
| 8,853,627 | B2 | 10/2014 | Ouyang |
| 8,859,956 | B2 | 10/2014 | Ouyang |
| 8,859,957 | B2 | 10/2014 | Ouyang |
| 8,859,958 | B2 | 10/2014 | Ouyang |
| 8,859,959 | B2 | 10/2014 | Ouyang |
| 8,890,063 | B2 | 11/2014 | Ouyang |
| 8,895,916 | B2 | 11/2014 | Musselman |
| 8,895,918 | B2 | 11/2014 | Cooks |
| 8,927,926 | B2 | 1/2015 | Shimada |
| 8,932,875 | B2 | 1/2015 | Cooks |
| 8,933,398 | B2 | 1/2015 | Ouyang |
| 8,937,288 | B1 | 1/2015 | Cooks |
| 8,963,079 | B2 | 2/2015 | Ouyang |
| 8,963,101 | B2 | 2/2015 | Krechmer |
| 9,024,254 | B2 | 5/2015 | Cooks |
| 9,064,674 | B2 | 6/2015 | Ouyang |
| 9,105,435 | B1 | 8/2015 | Musselman |
| 9,116,154 | B2 | 8/2015 | Ouyang |
| 9,159,540 | B2 | 10/2015 | Ouyang |
| 9,165,752 | B2 | 10/2015 | Cooks |
| 9,224,587 | B2 | 12/2015 | Musselman |
| 9,230,792 | B2 | 2/2016 | Cooks |
| 9,337,007 | B2 | 5/2016 | Musselman |

(56) References Cited

U.S. PATENT DOCUMENTS

| | | | | |
|---|---|---|---|---|
| 9,484,195 | B2 | 11/2016 | Ouyang | |
| 9,500,630 | B2 | 11/2016 | Cooks | |
| 9,514,923 | B2 | 12/2016 | Krechmer | |
| 9,548,192 | B2 | 1/2017 | Cooks | |
| 9,558,926 | B2 | 1/2017 | Musselman | |
| 2002/0121596 | A1 | 9/2002 | Laiko | |
| 2002/0121598 | A1 | 9/2002 | Park | |
| 2002/0162967 | A1 | 11/2002 | Atkinson | |
| 2002/0185593 | A1 | 12/2002 | Doring | |
| 2002/0185595 | A1 | 12/2002 | Smith | |
| 2002/0185606 | A1 | 12/2002 | Smith | |
| 2003/0052268 | A1 | 3/2003 | Doroshenko | |
| 2004/0094706 | A1 | 5/2004 | Covey | |
| 2004/0129876 | A1 | 7/2004 | Franzen | |
| 2004/0159784 | A1 | 8/2004 | Doroshenko | |
| 2005/0230635 | A1 | 10/2005 | Takats | |
| 2005/0236374 | A1 | 10/2005 | Blankenship | |
| 2006/0266941 | A1 | 11/2006 | Vestal | |
| 2007/0114389 | A1 | 5/2007 | Karpetsky | |
| 2007/0228271 | A1 | 10/2007 | Truche | |
| 2008/0156985 | A1 | 7/2008 | Venter | |
| 2008/0202915 | A1 | 8/2008 | Hieftje | |
| 2008/0217254 | A1 | 9/2008 | Anderson | |
| 2010/0078550 | A1 | 4/2010 | Wiseman | |
| 2011/0215798 | A1 | 9/2011 | Beer | |
| 2012/0006983 | A1 | 1/2012 | Cody | |
| 2012/0138783 | A1* | 6/2012 | Peng | G01N 27/622 250/282 |
| 2012/0145890 | A1 | 6/2012 | Goodlett et al. | |
| 2012/0208004 | A1 | 8/2012 | Wolcott | |
| 2012/0223226 | A1 | 9/2012 | Rafferty | |
| 2012/0312980 | A1 | 12/2012 | Whitehouse | |
| 2012/0322683 | A1 | 12/2012 | Liu | |
| 2013/0020482 | A1 | 1/2013 | Enke | |
| 2013/0037710 | A1 | 2/2013 | Wu | |
| 2013/0082172 | A1* | 4/2013 | Syage | H01J 49/049 250/288 |
| 2013/0092832 | A1 | 4/2013 | Enke | |
| 2013/0273552 | A1 | 10/2013 | Ohashi | |
| 2013/0284915 | A1 | 10/2013 | Shimada | |
| 2014/0024822 | A1 | 1/2014 | Connolly | |
| 2015/0233866 | A1* | 8/2015 | Verenchikov | G01N 27/622 250/282 |
| 2016/0314956 | A1 | 10/2016 | Cooks | |

FOREIGN PATENT DOCUMENTS

| | | |
|---|---|---|
| JP | 2003222574 | 8/2003 |
| JP | 2007525677 | 6/2007 |
| JP | 2009539114 | 11/2009 |
| WO | WO03081205 | 10/2003 |
| WO | WO2005094389 | 10/2005 |
| WO | WO2008054393 | 5/2008 |
| WO | WO2008082603 | 7/2008 |
| WO | WO2015195599 | 12/2015 |
| WO | WO2016145041 | 9/2016 |

OTHER PUBLICATIONS

Cody, R.B. et al., "Versatile New Ion Source for the Analysis of Materials in Open Air under Ambient Conditions" Anal. Chem., 2005, 77, 2297-2302.

Cooks, R.G. et al., "Ambient Mass Spectrometry", Science, 2006, 311, 1566-1570.

Dalton, C.N. et al., "Electrospray-Atmospheric Sampling Glow Discharge Ionization Source for the Direct Analysis of Liquid Samples", Analytical Chemistry, Apr. 1, 2003, vol. 75, No. 7, pp. 1620-1627.

Garimella, S. et al., "Gas-flow assisted ion transfer for mass spectrometry", J. Mass Spectrom. 2012, 17, 201-207.

Guzowski, J.P. Jr. et al., "Development of a Direct Current Gas Sampling Glow Discharge Ionization Source for the Time-of-Flight Mass Spectrometer", J. Anal. At. Spectrom., 14, 1999, pp. 1121-1127.

Haddad, R., et al., "Easy Ambient Sonic-Spray Ionization Mass Spectrometry Combined with Thin-Layer Chromatography," *Analytical Chemistry*, vol. 80, No. 8, Apr. 15, 2008, pp. 2744-2750.

Harris, Glenn A. et al., Ambient Sampling/Ionization Mass Spectrometry: Applications and Current Trends, Apr. 15, 2011, Anal. Chem. 2011, 83, pp. 4508-4538.

Harris, Glenn A. et al., Simulations and Experimental Investigation of Atmospheric Transport in an Ambient Metastable-Induced Chemical Ionization Source, Anal. Chem. 2009, 81, pp. 322-329.

Hill, C.A. et al., "A pulsed corona discharge switchable high resolution ion mobility spectrometer-mass spectrometer", Analyst, 2003, 128, pp. 55-60.

Hiraoka, K. et al., "Atmospheric-Pressure Penning Ionization Mass Spectrometry", Rapid Commun. Mass Spectrom., 18, 2004, pp. 2323-2330.

McLuckey, S.A. et al., "Atmospheric Sampling Glow Discharge Ionization Source for the Determination of Trace Organic Compounds in Ambient Air", Anal. Chem., 60, 1988, pp. 2220-2227.

Otsuka, K. et al., "An Interface for Liquid Chromatograph/Liquid Ionization Mass Spectrometer", Analytical Sciences, Oct. 1988, vol. 4, pp. 467-472.

Takáts et al., "Mass Spectrometry Sampling Under Ambient Conditions with Desorption Electrospray Ionization," Science, vol. 306, No. 5695, Oct. 15, 2004, pp. 471-473.

Tembreull, R., et al., "Pulsed Laser Desorption with Resonant Two-Photon Ionization Detection in Supersonic Beam Mass Spectrometry," Anal. Chem., vol. 58, 1986, pp. 1299-1303, p. 1299.

Yang, H. et al., Argon Direct Analysis in Real Time Mass Spectrometry in Conjunction with Makeup Solvents, A method for Analysis of Labile Compounds, Anal Chem, vol. 85, 2013, pp. 1305-1309.

Zhao, J. et al., Liquid Sample Injection Using an Atmospheric Pressure Direct Current Glow Discharge Ionization Source, Analytical Chemistry, Jul. 1, 1992, vol. 64, No. 13, pp. 1426-1433.

* cited by examiner

DOPANT-ASSISTED DIRECT ANALYSIS IN REAL TIME MASS SPECTROMETRY

FIELD OF THE INVENTION

The present invention relates to methods and devices for Direct Analysis in Real Time analysis with carrier gases in the presence of dopants.

BACKGROUND OF THE INVENTION

Direct Analysis in Real Time (DART) mass spectrometry is an ambient ionization method that is based on the interactions of excited-state atoms or molecules with the analyte and atmospheric gases. With helium as the DART gas, the dominant positive-ion formation mechanism is commonly attributed to Penning ionization of atmospheric water by the very long lived (metastable) He* $2^3S_1$ state or $2^3S_0$ state. The He $2^3S_1$ state has an internal energy of 20.6 eV, while the He $2^3S_0$ state has an internal energy of 19.8 eV, which both exceed the 12.62 eV ionization energy of water. Following the initial Penning ionization step, proton transfer reactions occur between protonated water clusters and analytes with proton affinities greater than that of water (691 kJ mol-1). Other reaction mechanisms are possible, but the ionization energy and proton affinity of water are the dominant parameters for undertaking analysis with helium DART.

The internal energies of the metastable states for other noble gases neon, argon, krypton and xenon are 16.61 eV, 11.55*, 9.915, and 8.315 eV, respectively, (*for the $^3P_2$ state, (11.72 eV for the $^3P_0$ state). Neon DART results in identical chemistry to helium DART because its internal energy is greater than the ionization energy of water. Although it is not a noble gas, nitrogen has a number of long-lived vibronic excited states. The mechanisms involved in nitrogen DART are not well understood. The maximum energy available for Penning ionization by $N_2$* is given as 11.5 eV, but protonated water and ammonia and other species can be observed in the background mass spectrum with nitrogen DART gas. Further, $NO^+$ can be observed in nitrogen DART and is known to be a very reactive chemical ionization reagent ion.

SUMMARY OF THE INVENTION

In various embodiments of the present invention, a dopant is used together with argon DART in order to generate ions of analytes with different characteristics to the ions of the same analytes generated from conventional DART. In an embodiment of the invention, the combination of the conventional DART and argon DART spectra can be used to identify differences between analytes. In an alternative embodiment of the invention, the combination of the DART spectrum and the fragmentation spectrum of species generated with argon DART can be used to identify differences between analytes. In another embodiment of the invention, the combination of the conventional DART and argon DART spectra can be used to obtain structural information about an analyte. In another alternative embodiment of the invention, the combination of the DART spectrum and the fragmentation spectrum of species generated with argon DART can be used to obtain structural information about an analyte.

BRIEF DESCRIPTION OF THE DRAWINGS

This invention is described with respect to specific embodiments thereof. Additional aspects can be appreciated from the Figures in which.

DETAILED DESCRIPTION OF THE INVENTION

Definitions

Figure 1A:
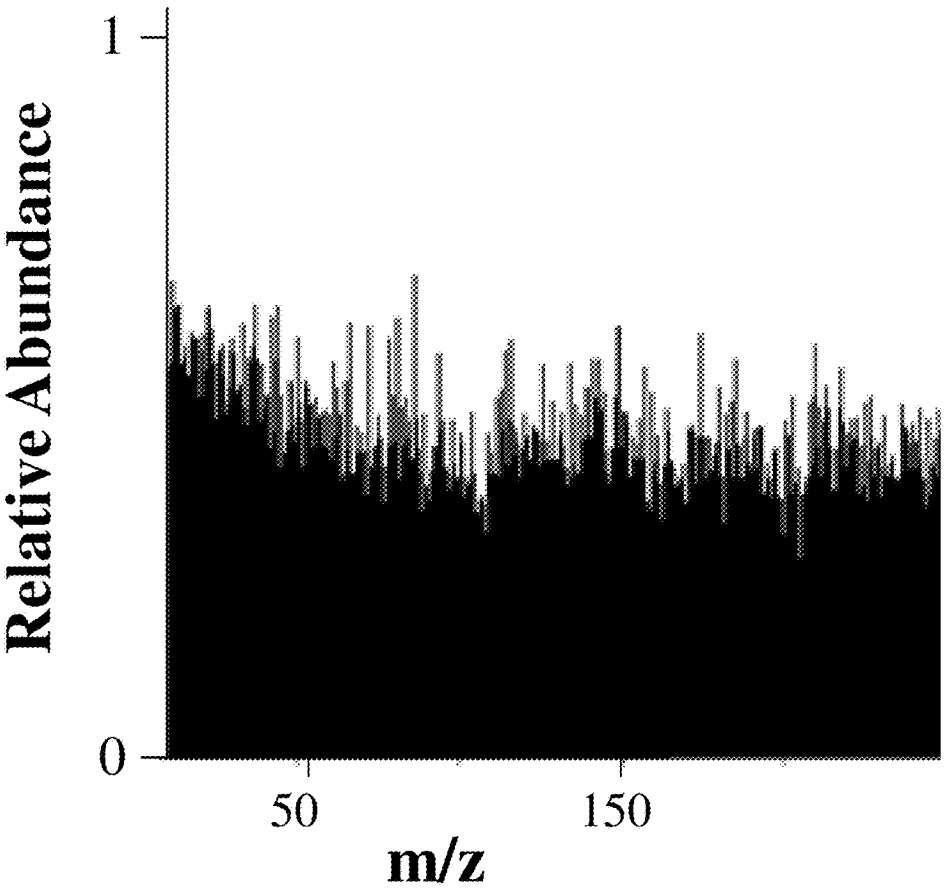
FIG. 1A shows a background positive-ion argon DART mass spectrum with no dopant and the y-axis scale magnified by 833.

The transitional term 'comprising' is synonymous with 'including', 'containing', or 'characterized by', is inclusive or open-ended and does not exclude additional, unrecited elements or method steps.

The transitional phrase 'consisting of' excludes any element, step, or ingredient not specified in the claim, but does not exclude additional components or steps that are unrelated to the invention such as impurities ordinarily associated with a composition.

The transitional phrase 'consisting essentially of' limits the scope of a claim to the specified materials or steps and those that do not materially affect the basic and novel characteristic(s) of the claimed invention.

The phrase 'carrier gas' means a gas that is introduced into a DART source which generates the metastable neutral species which are used to ultimately form gas phase ions of analytes, either by directly interacting with analyte molecules or through the action of the metastable neutral species on an intermediate species.

The phrase 'molecular ion' means $M^{+}$. or $M^{-}$. as an ionized species. The phrase predominantly molecular ion species means that the measured mass spectrum contains the $M^{+}$. or $M^{-}$. species with a relative intensity of greater than approximately sixty (60) percent, where approximately is ±ten (10) percent.

The phrase 'protonated molecule ion' means $[M+H]^{+}$ as an ionized species. The phrase 'predominantly protonated molecule ion species' means that the measured mass spectrum contains the $[M+H]^{+}$ species with a relative intensity of greater than approximately sixty (60) percent, where approximately is ±ten (10) percent.

The phrase 'deprotonated molecule ion' means $[M-H]^{-}$ as an ionized species. The phrase 'predominantly deprotonated molecule ion species' means that the measured mass spectrum contains the $[M-H]^{-}$ species with a relative intensity of greater than approximately sixty (60) percent, where approximately is ±ten (10) percent.

The phrase 'proton transfer' when referring to dopant DART means that the metastable DART gas can ionize (without transferring a proton) a dopant, a sample molecule with a suitably low ionization energy or a background molecule, and these species can undergo ion molecule reactions ultimately resulting in the transfer of a proton to an analyte.

The phrase 'Direct Analysis in Real Time' abbreviated as 'DART' means an ionization process with a carrier gas whereby a discharge is used to generate an excited metastable neutral carrier gas species which can be directed at an analyte to ionize the analyte.

The phrases 'helium DART', 'nitrogen DART', 'neon DART', 'argon DART', 'krypton DART' and 'xenon DART' mean a DART ionization process where the carrier gas is helium, nitrogen, neon, argon, krypton and xenon gases respectively.

The symbol 'He*' means an excited metastable helium species. The symbol '$N_2$*' means an excited metastable nitrogen species. The symbol 'Ne*' means an excited metastable neon species. The symbol 'Ar*' means an excited metastable argon species. The symbol 'Kr*' means an excited metastable krypton species. The symbol 'Xe*' means an excited metastable xenon species.

The word or phrases 'conventional', 'conventional DART' or 'conventional DART source' mean an ionization process with a carrier gas selected from one or more of helium, nitrogen and neon gases that when interacting directly with an analyte produce predominantly either protonated molecule ion species (positive mode) or deprotonated molecule ion species (negative mode). By definition, a conventional DART source generates one or more of He*, $N_2$* and Ne* containing carrier gases to interact with the analyte.

The phrase 'argon DART' means a DART ionization process with an argon carrier gas. The phrase 'krypton DART' means a DART ionization process with a krypton carrier gas. The phrase 'xenon DART' means a DART ionization process with an xenon carrier gas. By definition, an argon DART source generates an Ar* containing carrier gas. By definition, a krypton DART source generates a Kr* containing carrier gas. By definition, a xenon DART source generates a Xe* containing carrier gas.

The phrase 'efficient dopant' means a dopant that produces a species able to act as a donor (positive mode) or acceptor (negative mode) in a charge exchange and/or proton transfer reaction with the analyte of interest.

The phrase 'dopant-assisted DART' or 'dopant DART' means an ionization process where an efficient dopant is introduced into the carrier gas. In various embodiments of the invention, an efficient dopant is a compound having an ionization energy lower than the internal energy of the metastable carrier gas that is suitable for one or both charge exchange and proton transfer to analyte compounds.

The phrase 'dopant-assisted argon DART' means an ionization process where the carrier gas is argon and an efficient dopant is introduced into the Ar*. In various embodiments of the invention, an efficient dopant is a compound having an ionization energy lower than the internal energy of Ar* that is suitable for one or both charge exchange and proton transfer to analyte compounds.

The phrase 'ion activation' means collisionally activated dissociation, collision induced dissociation, in source fragmentation, ion metastable fragmentation, ion surface collisions, ion induced dissociation, photodissociation, ion neutral collisions, ion electron collisions, ion electron collisions, electron capture dissociation or function switching. Fragment ions can be formed from a precursor by exciting the precursor either by way of collision or otherwise transferring energy to cause bond scission in the precursor.

The word 'simultaneously' is used to refer to a process where the formation of two different species occurs at relatively the same, but not the exact same time. Simultaneous formation of two species can be contrasted with a process where predominantly a first species is formed and then at a later time at least one (1) second after predominantly a second species is formed.

The word 'deployed' means attached, affixed, adhered, inserted, located or otherwise associated.

The phrase 'mass spectrometer system' means an instrument selected from the group consisting of a sector, a double focusing sector, a single quadrupole, a triple quadrupole, a quadrupole ion trap (Paul trap), a linear ion trap, a rectilinear ion trap, a cylindrical ion trap, an ion cyclotron resonance trap, an orbitrap, and a time of flight mass spectrometer. A mass spectrometer system is able to isolate and excite or otherwise generate fragment ions of an analyte (precursor) species.

The phrase 'trapped ion device' includes a quadrupole ion trap, a linear ion trap, a rectilinear ion trap, a cylindrical ion trap, an ion cyclotron resonance trap, and an orbitrap.

The phrase 'mass filter' means a mode, a selection, or a scan carried out using a mass spectrometer system.

The word 'cell' means a vessel used to contain one or more of a homogeneous or heterogeneous liquid, gas or solid sample.

The word 'screen' means two or more connected filaments, a mesh, a grid or a sheet. In various embodiments of the present invention, a screen includes three or more connected filaments where at least one filament is approximately orthogonal to one other filament. A screen thickness is greater than approximately 20 micrometer and less than approximately one centimeter, where approximately is ±twenty (20) percent. A metallic screen is a screen where the filaments, mesh, grid or sheet block magnetic coupling.

The word 'directing' means causing a carrier gas and or ions formed in part by the carrier gas to one or both impinge and interact with a sample.

The word 'combining' means using two or more extracted pieces of information observed in measuring the mass to charge ratio of ions formed from a sample to determine one or more chemical features of the sample.

The phrase 'chemical feature of a sample' means the elemental composition, chemical structure or part thereof.

The word 'measuring' means using a mass spectrometer system and/or a mass filter to extract one or more pieces of information observed in measuring the mass to charge ratio of ions formed from a sample.

The phrases 'metastable carrier gas', 'metastable neutral carrier gas', 'metastable DART gas' or 'metastable DART carrier gas' mean a gas containing an excited metastable species that is suitable for one or both charge exchange and proton transfer to one or more analyte compounds. Gases having an appropriate internal energy to act as carrier gases include helium, nitrogen, neon, argon, krypton, and xenon.

The phase 'conventional carrier gas' means the carrier gas used with a conventional DART source.

The phrase 'intact ion' or 'intact molecule ion' means one or more of a protonated molecule ion, a deprotonated molecule ion, a molecular ion, an adduct molecule positive ion and an adduct molecule negative ion.

The phrase 'dopant DART source' means one or more of an argon DART source, a krypton DART source and a xenon DART source.

The phrase 'dopant carrier gas' means the carrier gas used with a dopant DART source.

The phrases 'metastable dopant carrier gas', is produced by introducing a dopant carrier gas into a dopant DART source.

The phrase 'dopant ions' means an ion generated by the interaction of a dopant with a dopant carrier gas.

A 'filament' means a wire with a diameter greater than approximately 20 micrometer and less than approximately one centimeter, where approximately is ±twenty (20) percent.

A gas ion separator means the device described in U.S. Pat. No. 7,700,913, which disclosure is herein explicitly incorporated by reference in its entirety.

A 'metal' comprises one or more elements consisting of lithium, beryllium, boron, carbon, nitrogen, oxygen, sodium, magnesium, aluminum, silicon, phosphorous, sulfur, potassium, calcium, scandium, titanium, vanadium, chromium, manganese, iron, cobalt, nickel, copper, zinc, gallium, germanium, arsenic, selenium, rubidium, strontium, yttrium, zirconium, niobium, molybdenum, technetium, ruthenium, rhodium, palladium, silver, cadmium, indium, tin, antimony, tellurium, cesium, barium, lanthanum, cerium, praseodymium, neodymium, promethium, samarium, europium, gadolinium, terbium, dysprosium, holmium, erbium, thulium, ytterbium, lutetium, hafnium, tantalum, tungsten, rhenium, osmium, iridium, platinum, gold, mercury, thallium, lead, bismuth, polonium, francium and radium.

In the following description, various aspects of the present invention are described. However, it will be apparent to those skilled in the art that the present invention can be practiced with only some or all aspects of the present invention. For purposes of explanation, specific numbers, materials, and configurations are set forth to provide a thorough understanding of the present invention. However, it will be apparent to one skilled in the art that the present invention can be practiced without the specific details. In other instances, well-known features are omitted or simplified in order not to obscure the present invention.

Parts of the description are presented in data processing terms, such as data, selection, retrieval, generation, and so forth, consistent with the manner commonly employed by those skilled in the art to convey the substance of their work to others skilled in the art. As is well understood by those skilled in the art, these quantities (data, selection, retrieval, generation) can take the form of electrical, magnetic, or optical signals capable of being stored, transferred, combined, and otherwise manipulated through electrical, optical, and/or biological components of a processor and its subsystems.

Various operations are described as multiple discrete steps in turn, in a manner that is helpful in understanding the present invention; however, the order of description should not be construed as to imply that these operations are necessarily order dependent.

Various embodiments are illustrated in terms of exemplary classes and/or objects in an object-oriented programming paradigm. It will be apparent to one skilled in the art that the present invention can be practiced using any number of different classes/objects, not merely those included here for illustrative purposes.

Aspects of the invention are illustrated by way of example and not by way of limitation in the Figures of the accompanying drawings in which like references indicate similar elements. It should be noted that references to 'an' or 'one' embodiment in this disclosure are not necessarily to the same embodiment, and such references mean at least one.

Argon has not been widely used in DART because the lower internal energy of Ar* does not result in the formation of water ions. Therefore, argon can only undergo Penning ionization with analytes having relatively low ionization energies. Typically, only samples with ionization energies lower than the internal energy of the metastable argon $^3P_2$ and $^3P_0$ states (11.55 and 11.72 eV, respectively) can be ionized. Argon DART has been used to selectively ionize melamine contamination in powdered milk. The initial step involved Ar* Penning ionization of acetyl acetone (AcAc). This was then followed by a series of proton transfer reactions between protonated AcAc and pyridine. Finally, the protonated pyridine reacted with the melamine present in the milk.

Penning ionization and photoionization are closely related phenomena. The internal energy of the excited-state neutral in Penning ionization, or the photon energy in photoionization, determines the reagent ions that play a role in subsequent atmospheric pressure ion-molecule reactions in DART. In an embodiment of the present invention, DART can be operated with argon gas by adding an efficient dopant to the metastable DART gas stream as shown in FIG. 7.

An AccuTOF-LP 4G (JEOL Ltd., Akishima, Japan) time-of-flight mass spectrometer equipped with a Direct Analysis in Real Time (DART-SVP) ion source (IonSense Inc., Saugus, Mass.) was used for all measurements. Unless otherwise noted, mass spectra were stored at a rate of one spectrum per second and the voltages on the atmospheric pressure interface (API) were: orifice-1=20V, and orifice-2=ring lens=5V. The RF ion guide voltage was set to 70 V to observe low-mass atmospheric background ions and dopant reagent ions (m/z 10-800), or set to 550 V for sample measurements (m/z 60-800). The monoamine-terminated poly(ethylene oxide) polymer Jeffamine M-600 (Huntsman, The Woodlands, Tex.) was measured in each data file as a reference standard for exact mass measurements, and perfluorotributylamine (PFTBA) was used as a mass reference standard for negative-ion measurements.

Acetone (Sigma-Aldrich Chromasolv® 99.9%), toluene (J. T. Baker, Ultra-Resi-Analyzed, 99.7%), and anisole (Sigma-Aldrich Reagent-Plus, 99%) were used as supplied without further treatment. Argon (Matheson, Grade 5.0) and helium (Matheson, Grade 4.7) were used as carrier gases as supplied without further treatment. Successive dilutions of a mixture of unlabeled Polycyclic Aromatic Hydrocarbons (PAH) (Cambridge Isotope Laboratories, PAH Native Standard Mixture ES-5438) in toluene were carried out to evaluate sensitivity and detection limits.

Dopants were infused at a rate of 9 μL $min^{-1}$ through deactivated fused silica tubing by using a syringe pump (WPI sp200i, World Precision Instruments, Shanghai, China). This value was determined by varying the flow rate from 1 μL $min^{-1}$ to 14 μL $min^{-1}$. Beyond 9 μL $min^{-1}$, there was no significant change in the signal intensity for the anisole molecular ion.

Forceps mounted on a stand were used to position the exit tip of the fused silica directly in front of the ceramic insulator at the metastable DART gas exit. The liquid dopants evaporated directly into the metastable DART gas stream. Unless otherwise noted, dopant-assisted argon DART mass spectra reported herein were measured by using 0.5% anisole in toluene as the efficient dopant. As a result, this efficient dopant mixture can be used for the analysis of solutions in methanol without requiring prior drying of the sample. In various embodiments of the invention, dopants include chlorobenzene, bromobenzene, 2, 4-difluoroanisole, and 3-(trifluoromethyl)anisole.

Figure 6:
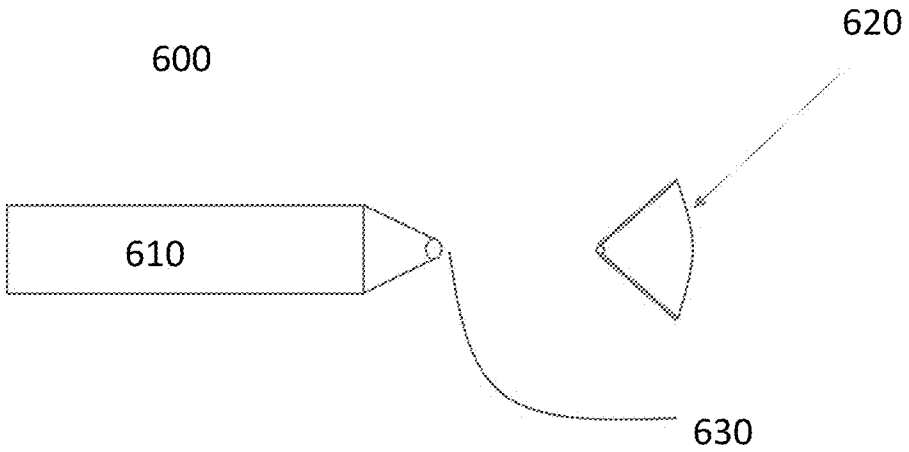
FIG. 6 shows a schematic of the position of the DART gun relative to orifice-1 in the DART source, according to various embodiments of the invention.

FIG. 6 shows a schematic of the DART source 600 with the DART gun 610 position relative to orifice-1 620. The DART gun 610 was positioned approximately 1 cm from the apex of the mass spectrometer sampling orifice ("orifice-1") 620, where approximately is ±thirty (30) percent. The dopant was introduced through a feed 530 positioned in front of the DART gun. Unless otherwise noted the DART gas heater was set to 300° C. Argon and helium can be introduced to the DART controller through the same gas line. The gas selection was determined by opening and closing the valves on the gas supply cylinders. Supply lines to the DART were purged with the valves on both gas cylinder lines closed when switching between helium and argon. The DART was set to standby mode with nitrogen purge gas when not actively measuring samples. Flow regulators in the DART SVP controller set the gas flow rate for all gases to one (1) liter per minute. In various embodiments of the invention, ion activation can be carried out with tandem mass spectrometry (MS/MS) systems or with in-source fragmentation. In various embodiments of the invention, in-source fragmentation can be accomplished by adjusting the voltages in the atmospheric pressure interface to increase the ion kinetic energies as they collide with neutral gas molecules in the interface region (function switching in an AccuTOF). The specific fragments observed in tandem mass spectrometry or in-source fragmentation vary with collision energy. For the examples given here, the term 'orifice-1 voltage' refers to the collision energy for in-source fragmentation of ions produced by DART ionization.

Samples were measured by pipetting 3 μL of sample solutions onto the sealed end of a melting point tube, allowing the solvent to dry, and then suspending the sealed end of the tube directly in front of the metastable DART gas exit and the fused silica capillary used to introduce the dopant.

Polyethers such as poly(ethylene oxide) also known as polyethylene glycol or "PEG" are commonly used as reference standards for mass calibration for DART. Toluene or toluene/anisole is not an efficient dopant for the analysis of polyethers with argon DART. However, Jeffamine M-600 (Huntsman), a monoamine-terminated poly(propylene oxide), is efficiently ionized, producing abundant protonated molecule species when analyzed under these conditions. The anisole molecular ion was included together with the Jeffamine $[M+H]^+$ peaks in the calibration to provide a reference peak at m/z 108.05751.

No peaks were observed in negative-ion mode with argon DART for PEG or for perfluoropropyl ether (Fomblin Y). The latter is a reference standard for negative-ion mode measurements with helium DART. In various embodiments of the invention, argon DART analysis of perfluorotributylamine (PFTBA) generated a spectrum containing a set of species that can be used as reference standards.

Figure 7A:
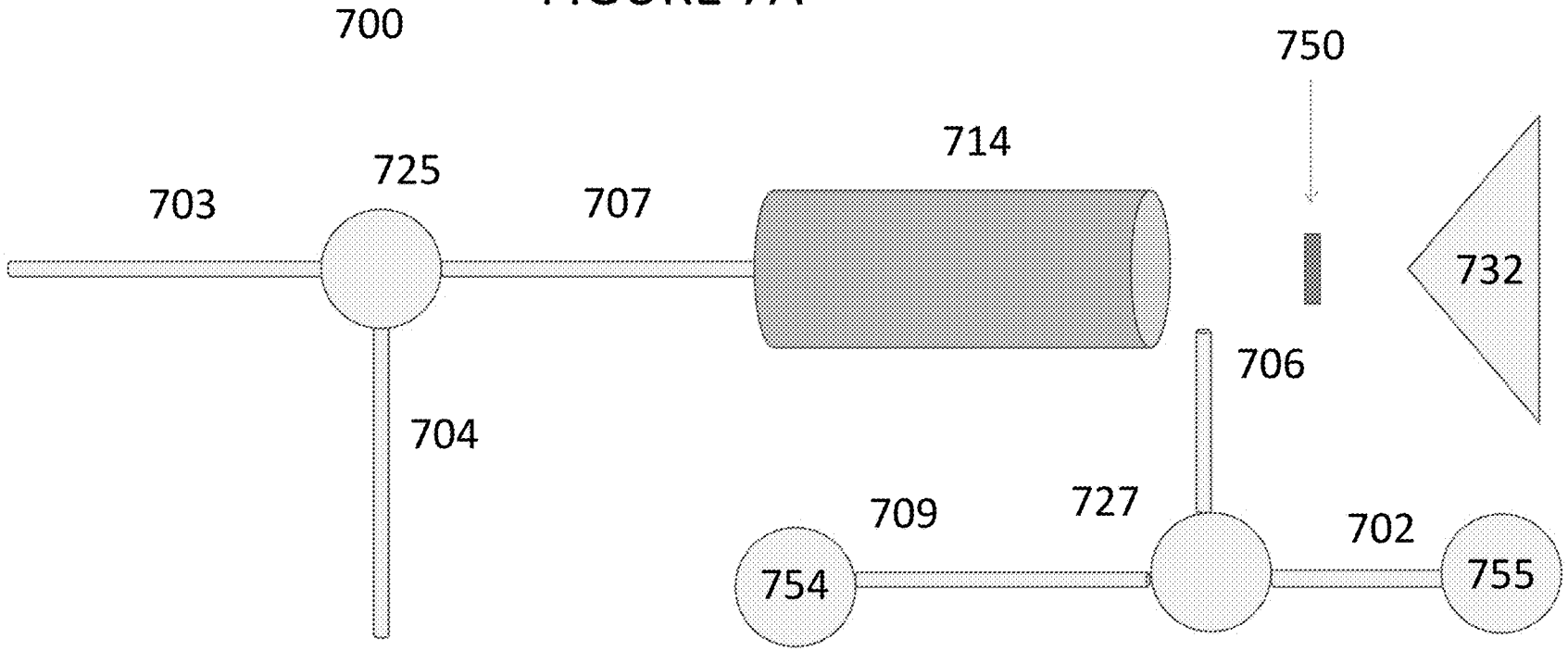
FIG. 7A shows a schematic of a DART source for operating as conventional DART source or a dopant DART source, according to various embodiments of the invention.

FIG. 7A shows a schematic of an instrument configuration 700 where the DART source 714 can be used as a conventional DART source initially (or subsequently) which is supplied with a conventional carrier gas (for example one or more of He, Ne or $N_2$ gases) through tubing 703, valve 725 and through tubing 707 to the DART source 714 to direct the metastable DART gas (for example excited atoms) (not shown) toward the sample 750 and thereafter sample ions which enter the analyzer entrance 732. In an embodiment of the invention, the DART source 714 can be used as a dopant DART source subsequently (or initially) which is supplied with dopant carrier gas (for example one or more of Ar, Xe or Kr gases) through tubing 704, valve 725 and through tubing 707 to the DART source 714 to direct the metastable dopant carrier gas (not shown) to interact with one or more dopants introduced from one or more reservoirs 754, 755 through tubing 709, 702, valve 727 and through tubing 706 to interact with the excited atoms (not shown) and direct the dopant ions toward the sample 750 and thereafter sample ions which enter the analyzer entrance 732. In an embodiment of the invention, the analyzer entrance 732 can be an atmospheric pressure interface. In an alternative embodiment of the invention, the analyzer entrance 732 can incorporate a gas ion separator.

Figure 7B:
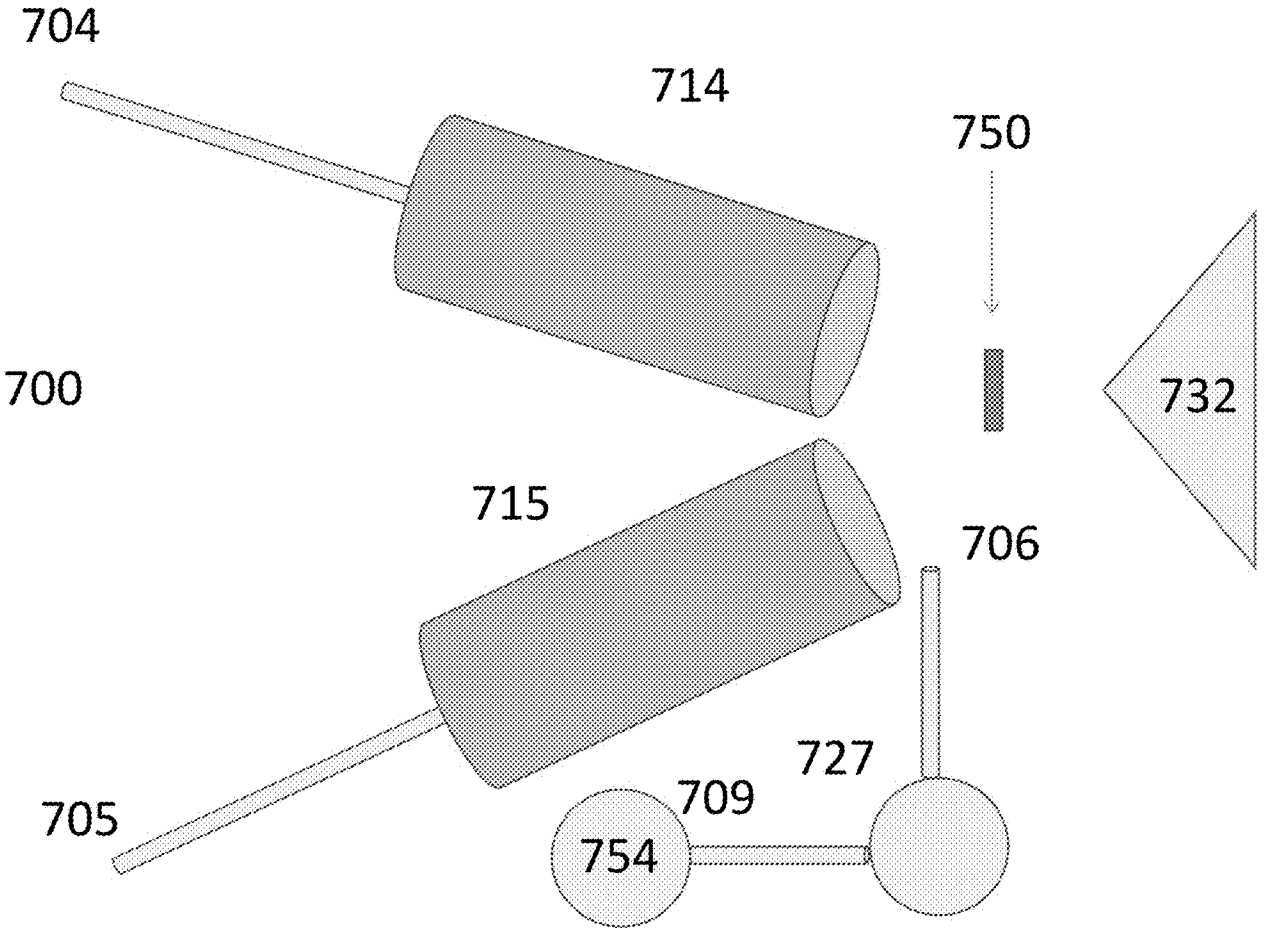
FIG. 7B shows a schematic of a dual source for operating simultaneously as a conventional DART source and a dopant DART source, according to various embodiments of the invention.

FIG. 7B shows a schematic of an instrument configuration 700 where conventional DART source 714 can be used initially, subsequently, or simultaneously supplied with a conventional carrier gas (for example one or more of He, Ne or $N_2$ gases) through tubing 704 to the DART source 714 to direct metastable DART gas (for example excited atoms) (not shown) toward the sample 750 and thereafter sample ions which enter the analyzer entrance 732. In an embodiment of the invention, the dopant DART source 715 supplied with dopant carrier gas (for example one or more of Ar, Xe or Kr gases) through tubing 705 can be used subsequently, initially or simultaneously, to direct the metastable dopant carrier gas (not shown) to interact with dopant introduced from reservoir 754 through tubing 709, valve 727 and through tubing 706 to form dopant ions (not shown) directed toward the sample 750 and thereafter sample ions which enter the analyzer entrance 732.

Figure 7C:
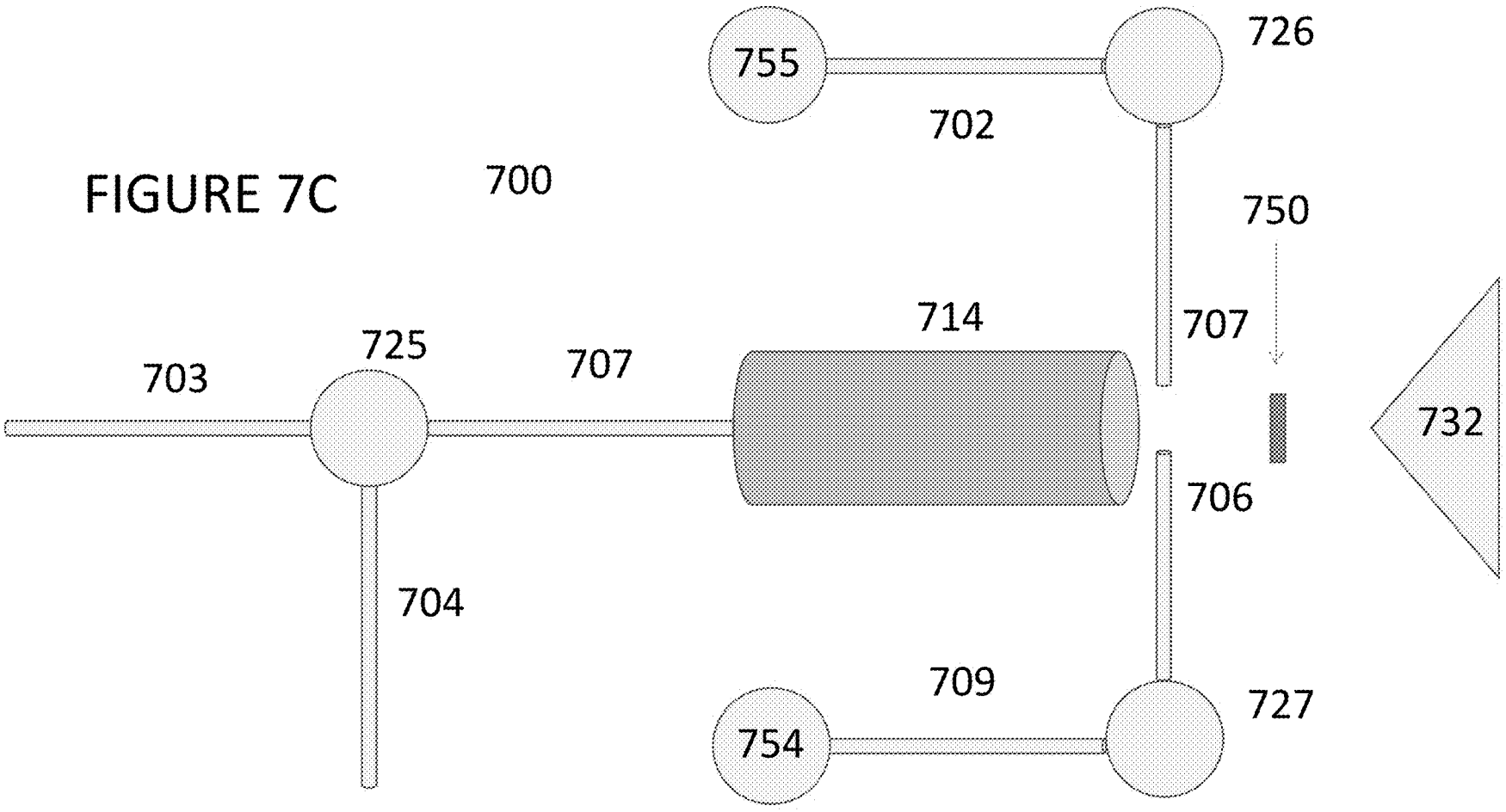
FIG. 7C shows a schematic of a DART source for operating as a conventional DART source or a dopant DART source with a dual dopant reservoir, according to various embodiments of the invention.

FIG. 7C shows a schematic of an instrument configuration 700 where the DART source 714 can be used as a conventional DART source initially (or subsequently) which is supplied with a conventional carrier gas (for example one or more of He, Ne or $N_2$ gases) through tubing 703, valve 725 and through tubing 707 to the DART source 714 to direct metastable DART gas (for example excited atoms) (not shown) toward the sample 750. In an embodiment of the invention, the DART source 714 can be used as a dopant DART source subsequently (or initially) which is supplied with dopant carrier gas (for example one or more of Ar, Xe or Kr gases) through tubing 704, valve 725 and through tubing 707 to the DART source 714 to direct the metastable dopant carrier gas (not shown) to interact with one or more dopants introduced from reservoirs 754, 755 through tubing 709, 702, valves 727, 728 and through tubing 706, 707 to interact with the excited atoms (not shown) and direct the dopant ions toward the sample 750 and thereafter sample ions which enter the analyzer entrance 732.

Figure 7D:
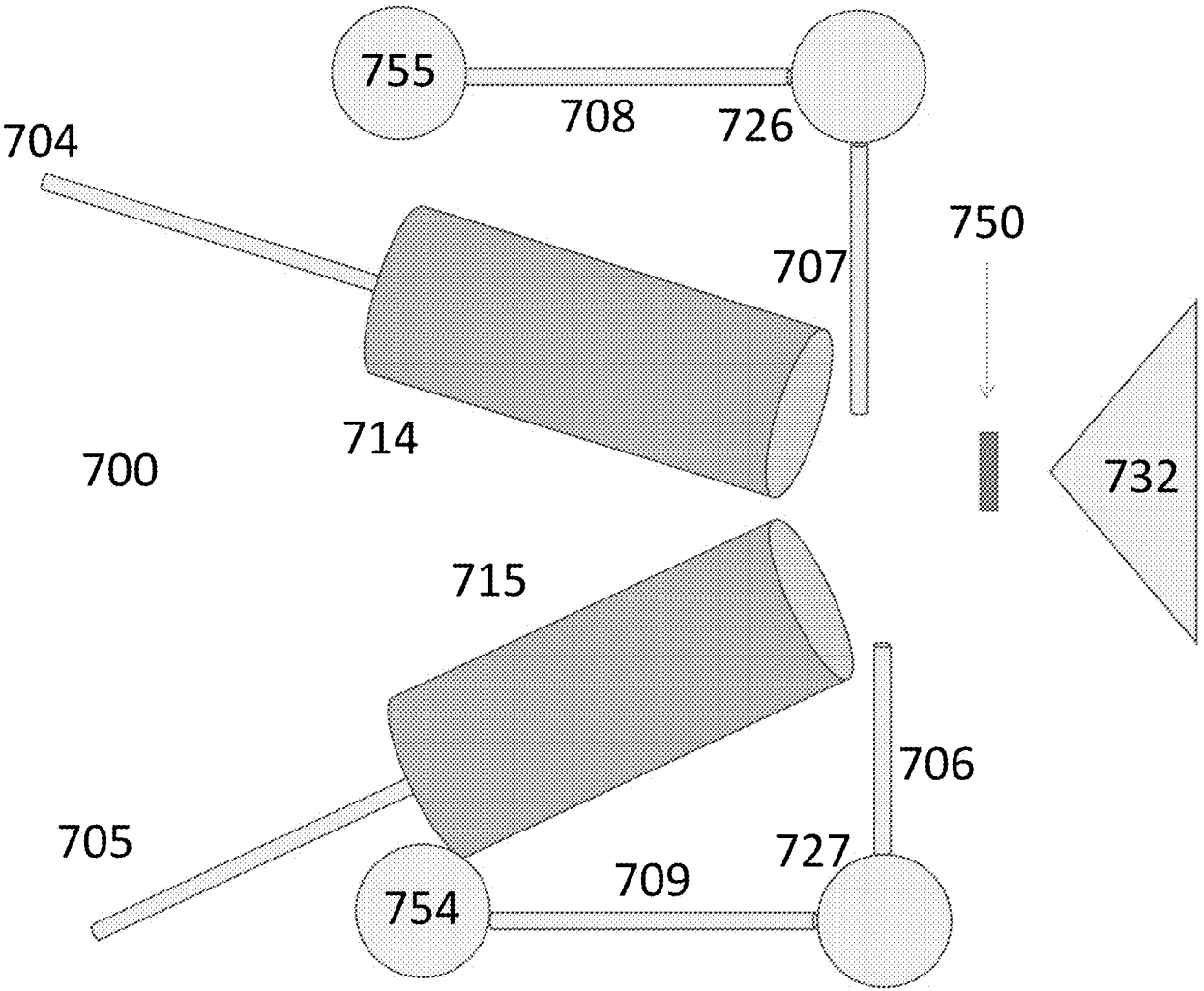
FIG. 7D shows a schematic of a dual DART source for operating simultaneously as a conventional DART source and a dopant DART source with a dual dopant reservoir, according to various embodiments of the invention.

FIG. 7D shows a schematic of an instrument configuration 700 where conventional DART source 714 can be used initially, subsequently, or simultaneously which is supplied with a conventional carrier gas (for example one or more of He, Ne or $N_2$ gases) through tubing 704 to the DART source 714 to direct metastable DART gas (for example excited atoms) (not shown) which interact with a dopant supplied from reservoir 755 through tubing 708, valve 726 and through tubing 707 to form dopant ions (not shown) directed toward the sample 750. In an embodiment of the invention, the dopant DART source 715 supplied with dopant carrier gas (for example one or more of Ar, Xe or Kr gases) through tubing 705 can be used subsequently, initially or simultaneously, to direct the metastable dopant carrier gas (not shown) to interact with dopant introduced from reservoir 754 through tubing 709, valve 727 and through tubing 706 to form dopant ions (not shown) directed toward the sample 750 and thereafter sample ions which enter the analyzer entrance 732.

Figure 7E:
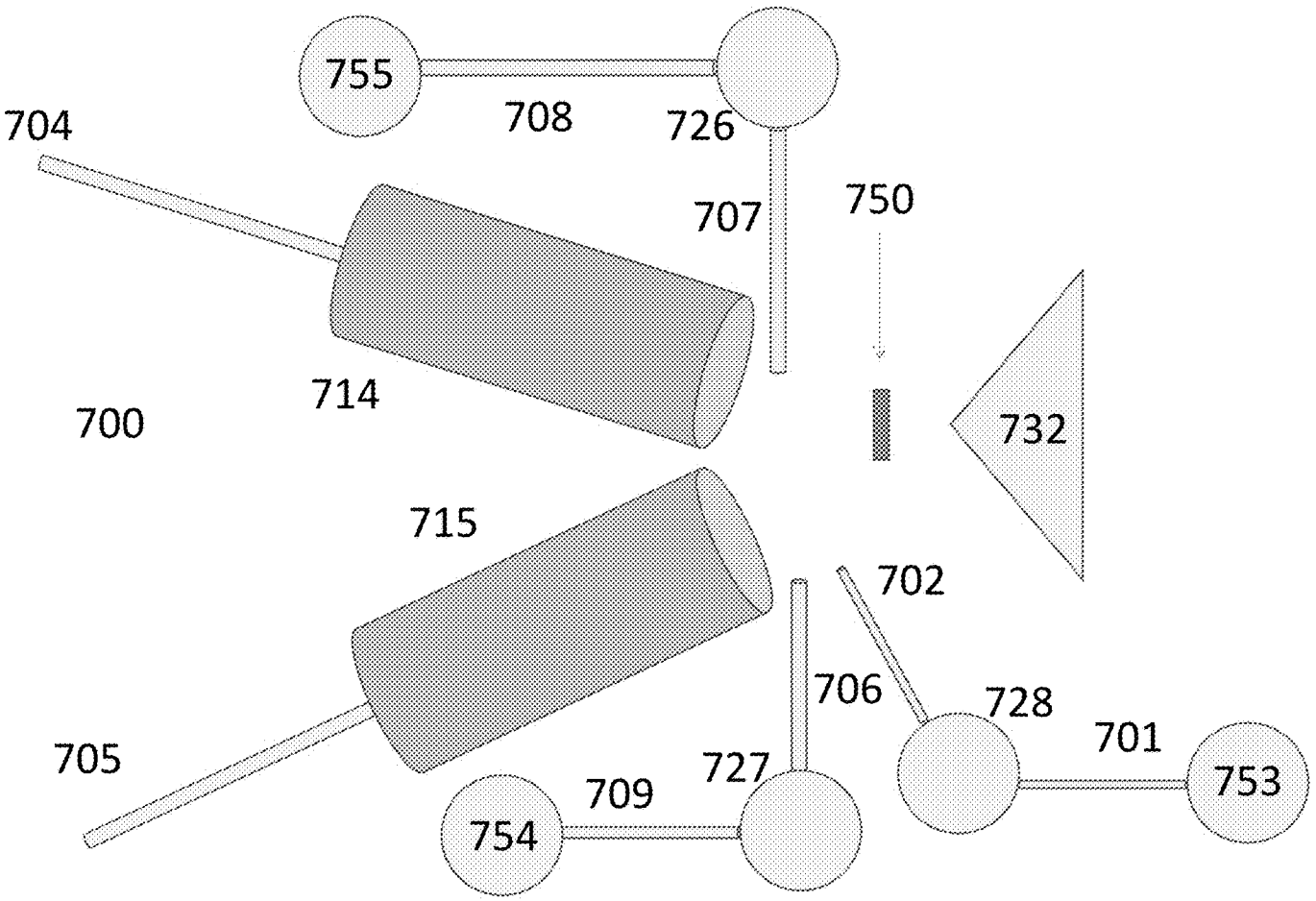
FIG. 7E shows a schematic of a dual DART source for operating simultaneously as a conventional DART source and a dopant DART source with multiple dopant reservoirs, according to various embodiments of the invention.

FIG. 7E shows a schematic of an instrument configuration 700 where conventional DART source 714 can be used initially, subsequently, or simultaneously which is supplied with a conventional carrier gas (for example one or more of He, Ne or $N_2$ gases) through tubing 704 to the DART source 714 to direct metastable DART gas (for example excited atoms) (not shown) which interact with a dopant supplied from reservoir 755 through tubing 708, valve 726 and through tubing 707 to form dopant ions (not shown) directed toward the sample 750 and thereafter sample ions which enter the analyzer entrance 732. In an embodiment of the invention, the dopant DART source 715 supplied with dopant carrier gas (for example one or more of Ar, Xe or Kr gases) through tubing 705 can be used subsequently, initially or simultaneously, to direct the metastable dopant carrier gas (not shown) to interact with dopant introduced from reservoirs 754, 753 through tubing 709, 701, valves 727, 728 and through tubing 706, 702 to form dopant ions (not shown) directed toward the sample 750 and thereafter sample ions which enter the analyzer entrance 732.

Figure 7F:
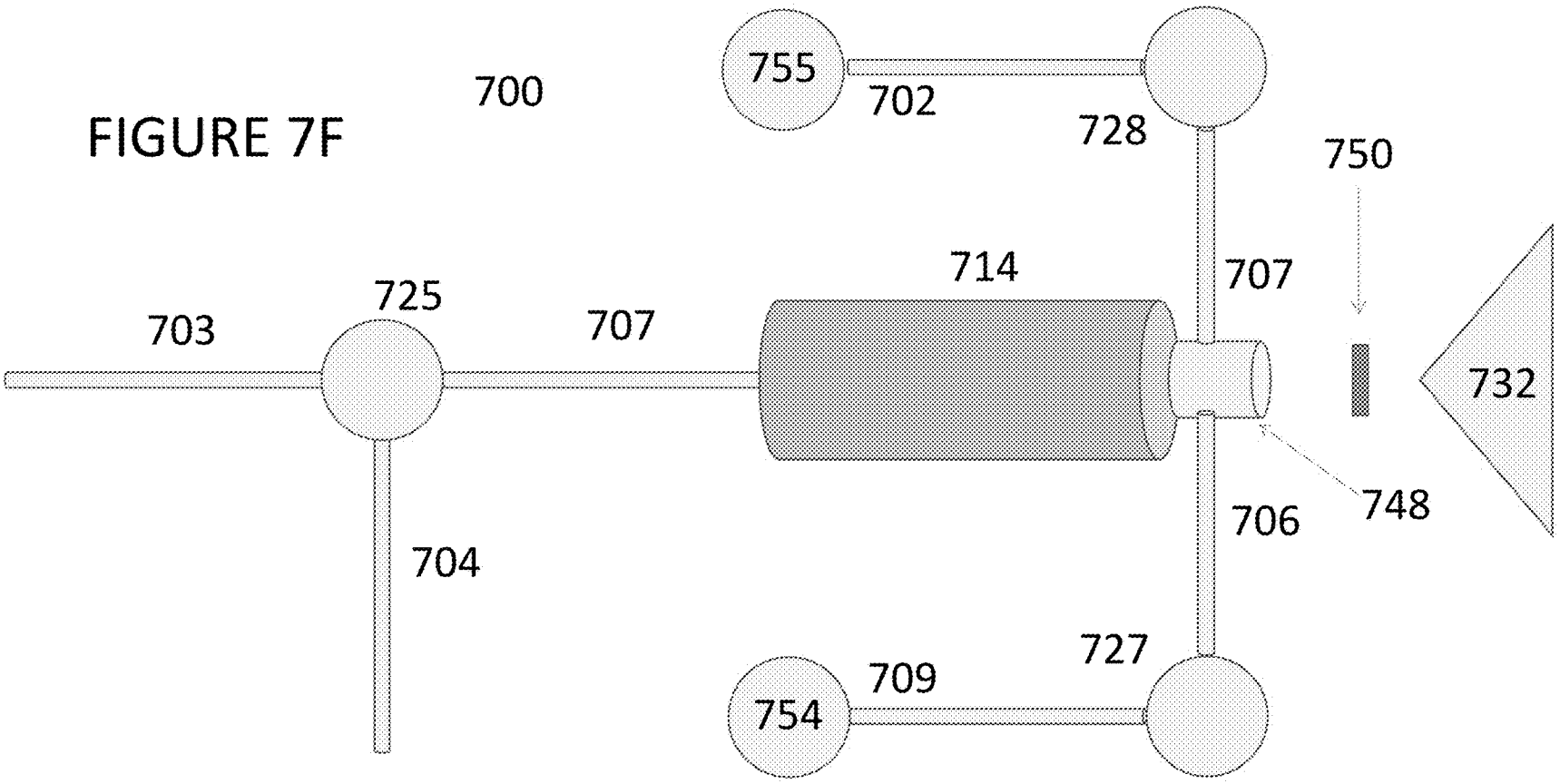
FIG. 7F shows a schematic of a DART source for operating as conventional DART source or a dopant DART source with a dual dopant reservoir, according to various embodiments of the invention.

FIG. 7F shows a schematic of an instrument configuration where the DART source 714 can be used as a conventional DART source initially (or subsequently) which is supplied with a conventional carrier gas (for example one or more of He, Ne or $N_2$ gases) through tubing 703, valve 725 and through tubing 707 to the DART source 714 to direct metastable DART gas (for example excited atoms) (not shown) toward the sample 750 and thereafter sample ions which enter the analyzer entrance 732. In an embodiment of the invention, the DART source 714 can be used as a dopant DART source subsequently (or initially) which is supplied with dopant carrier gas (for example one or more of Ar, Xe or Kr gases) through tubing 704, valve 725 and through tubing 707 to the DART source 714 to direct the metastable dopant carrier gas (not shown) to interact in mixing chamber 748 with one or more dopants introduced from reservoirs 754, 755 through tubing 709, 702, valves 727, 728 and through tubing 706, 707 to form dopant ions (not shown) directed toward the sample 750 and thereafter sample ions (not shown) which enter the analyzer entrance 732.

Figure 7G:
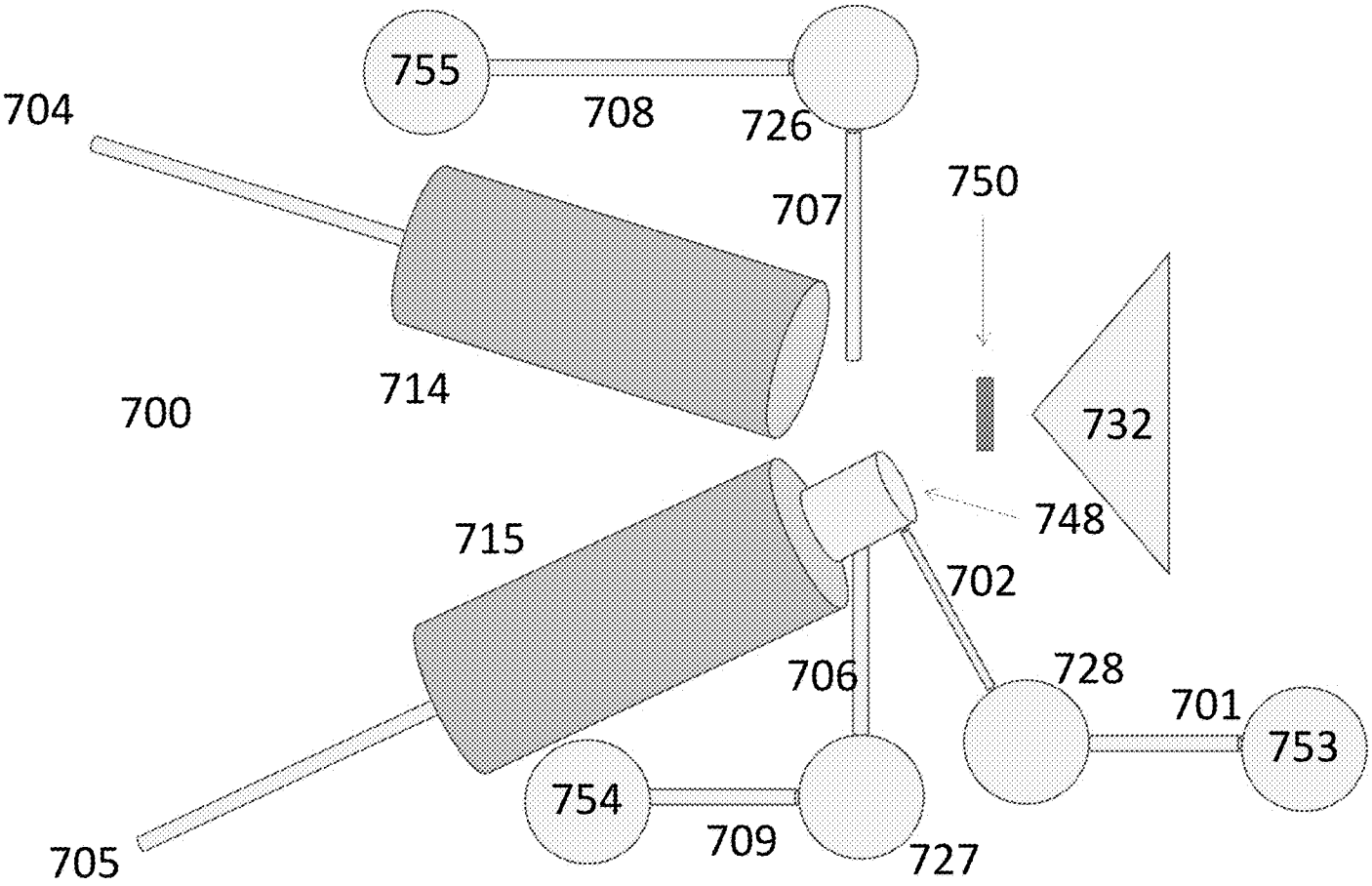
FIG. 7G shows a schematic of a dual DART source for operating simultaneously as a conventional DART source and a dopant DART source with multiple dopant reservoirs, according to various embodiments of the invention.

FIG. 7G shows a schematic of an instrument configuration 700 where conventional DART source 714 is used initially, subsequently, or simultaneously supplied with a conventional carrier gas (for example one or more of He, Ne or $N_2$ gases) through tubing 704 to the DART source 714 to direct metastable DART gas (for example excited atoms) (not shown) which optionally interact with a dopant supplied from reservoir 755 through tubing 708, valve 726 and through tubing 707 to either direct the excited atoms (not shown) and/or dopant ions (not shown) toward the sample 750 and thereafter sample ions which enter the analyzer entrance 732. In an embodiment of the invention, the dopant DART source 715 supplied with dopant carrier gas (for example one or more of Ar, Xe or Kr gases) through tubing 705 is used subsequently, initially or simultaneously, to direct the metastable dopant carrier gas (not shown) to interact in mixing chamber 748 with one or more dopants introduced from reservoirs 754, 753 through tubing 709, 701, valves 727, 728 and through tubing 706, 702 to form dopant ions (not shown) directed toward the sample 750 and thereafter sample ions (not shown) which enter the analyzer entrance 732.

Example 1

No ions are observed in the background spectrum covering the mass range corresponding to m/z 10-800 when argon was used without dopants (FIG. 1A). This suggests that argon ions do not play a role in DART ionization with argon gas, and provides support for a proposed ionization mechanism involving metastable argon atoms. In various embodiments of the invention, a gas with a sufficiently low ionization energy can be introduced to generate analyte ions.

Figure 1B:
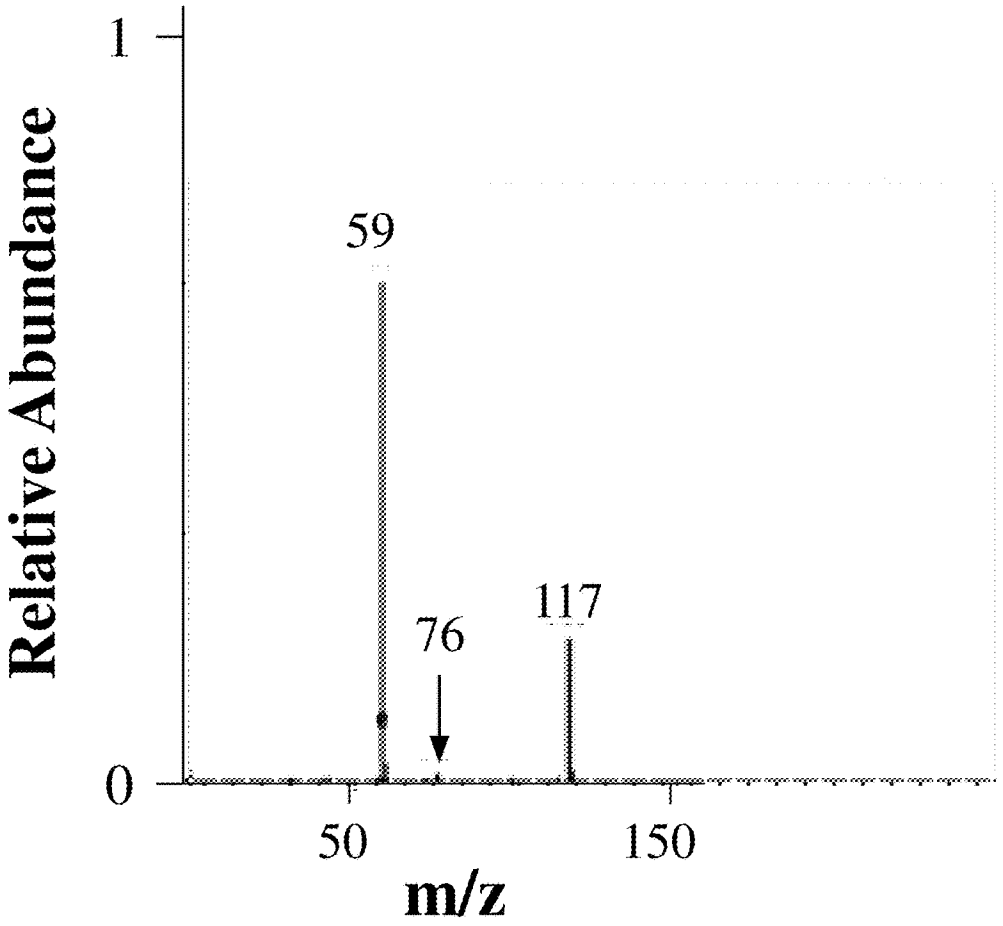
FIG. 1B shows a background positive-ion argon DART mass spectrum with an acetone dopant, according to an embodiment of the invention.
Figure 1C:
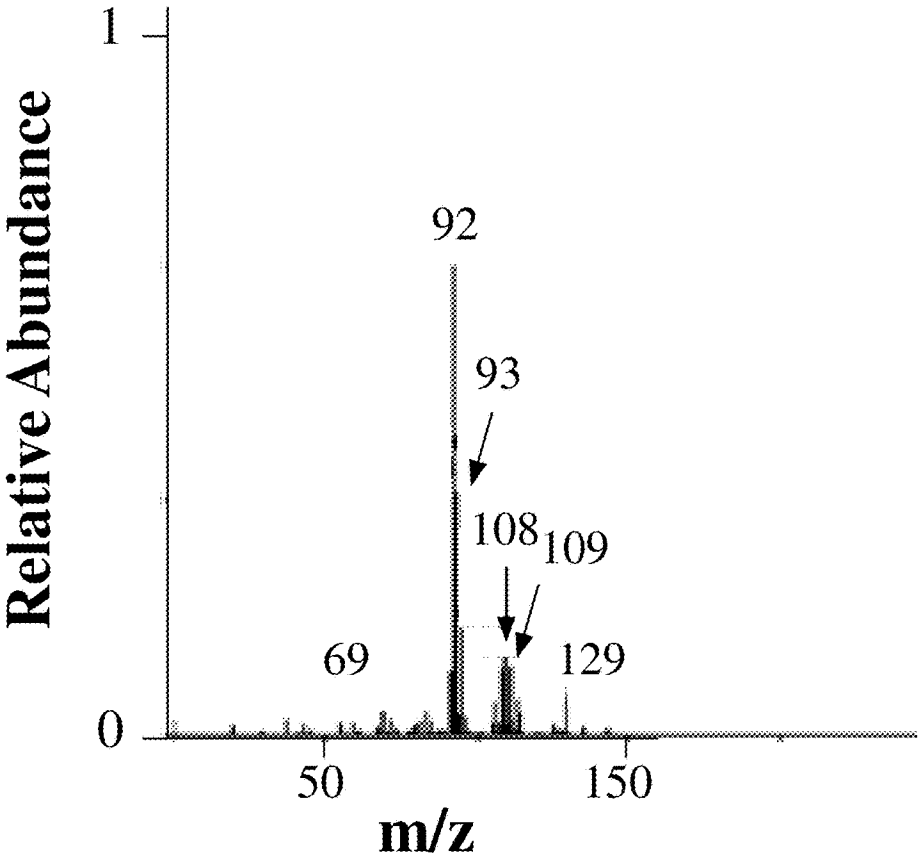
FIG. 1C shows a background positive-ion argon DART mass spectrum with a toluene dopant, according to an embodiment of the invention.
Figure 1D:
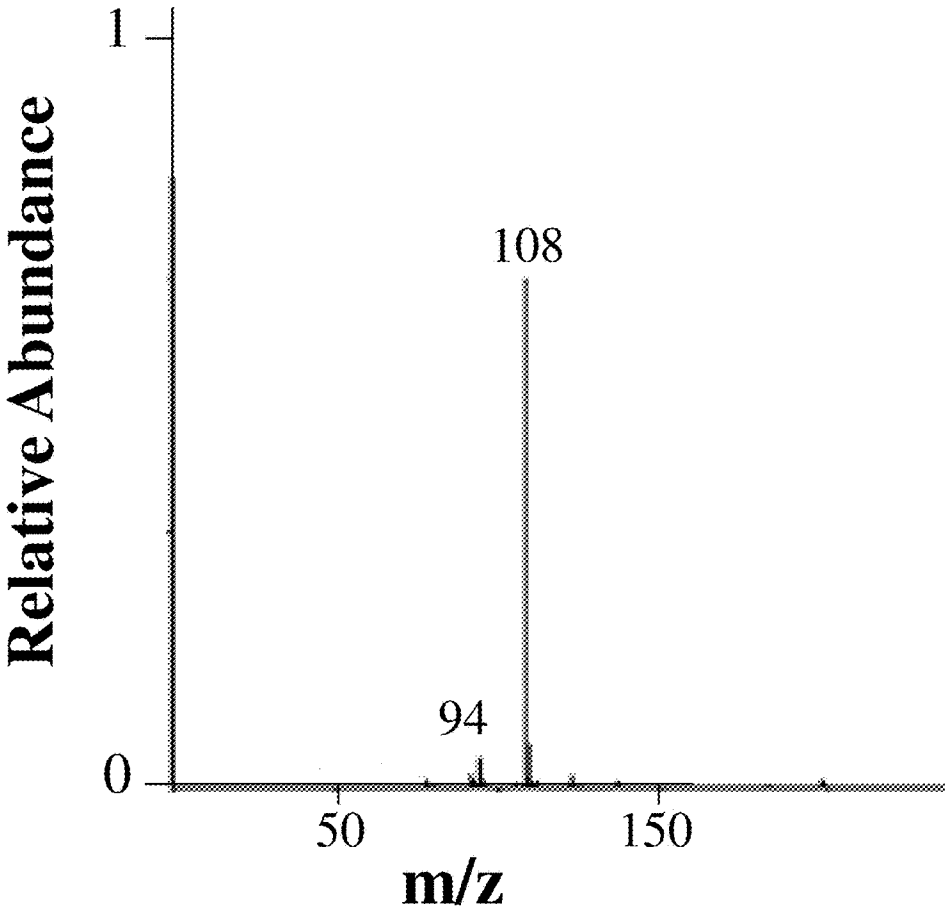
FIG. 1D shows a background positive-ion argon DART mass spectrum with a toluene and 0.5% anisole dopant, according to an embodiment of the invention.

FIG. 1A shows a background positive-ion argon DART mass spectra with no dopant and the y-axis scale magnified by 833. FIG. 1B shows a background positive-ion dopant-assisted argon DART mass spectra with an acetone dopant, with m/z 59, 76 and 117 identified, where the m/z of the major ions observed are identified in Table II. FIG. 1C shows a background positive-ion dopant-assisted argon DART mass spectrum with a toluene dopant, with m/z 69, 92, 93, 108, 109, and 129 identified, where the m/z of the major ions observed are identified in Table III. FIG. 1D shows a background positive-ion dopant-assisted argon DART mass spectrum with a toluene and 0.5% anisole dopant, with m/z 94 and 108 identified, where the m/z of the major ions observed are identified in Table IV. The chlorobenzene dopant-assisted argon DART mass spectrum (FIG. 1E) shows the chlorobenzene molecular ion as the base peak (112), with m/z 94 and 112 identified, where the m/z of the major ions observed are identified in Table V. In various embodiments of the invention, the spectra (FIG. 1B, FIG. 1C, FIG. 1D and FIG. 1E) contain peaks corresponding to molecular ions, protonated molecules, and small peaks that are possible ion-molecule reaction products. In particular, the acetone spectrum (FIG. 1B) shows protonated acetone and proton-bound dimer and a small acetone ammonium adduct $[M+NH_4]^+$ species. Trace environmental contamination from anisole is observed in the toluene spectrum (FIG. 1C). The toluene and anisole spectrum (FIG. 1D) shows traces of benzene, phenol, and methylated anisole and some impurities in the solvent, the plumbing, and/or the environment. The chlorobenzene mass spectrum (FIG. 1E) shows phenol (an impurity in the chlorobenzene) and anisole (from residual traces in the dopant plumbing) molecular ions.

Example 2

In various embodiments of the invention, all of the PAHs in the mixture (Table I) were detected as molecular ions (see FIG. 2) by analyzing the PAH sample using dopant-assisted argon DART with the toluene/anisole dopant. An additional component was observed at m/z 278.10941, which differs from the calculated m/z for the elemental composition $C_{22}H_{14}$ by 0.14 mmu. This is labeled on the mass spectrum as dibenz[a]anthracene, although it could be one or more of the isomeric $C_{22}H_{14}$ PAHs (see Table I).

Figure 2A:
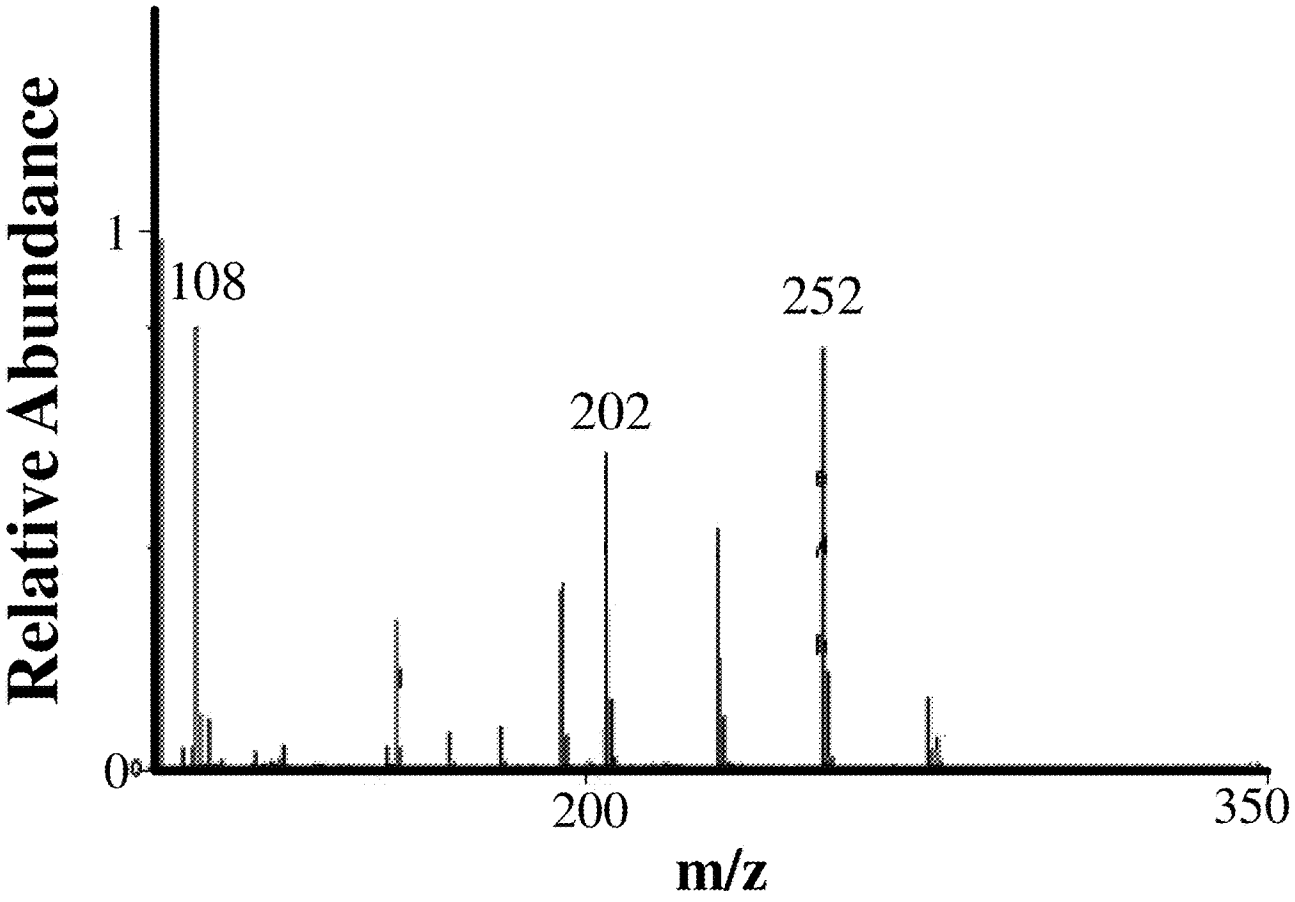
FIG. 2A shows a dopant-assisted argon DART mass spectrum for the PAH mixture at a concentration of 10 parts per million (ppm), according to an embodiment of the invention.
Figure 2B:
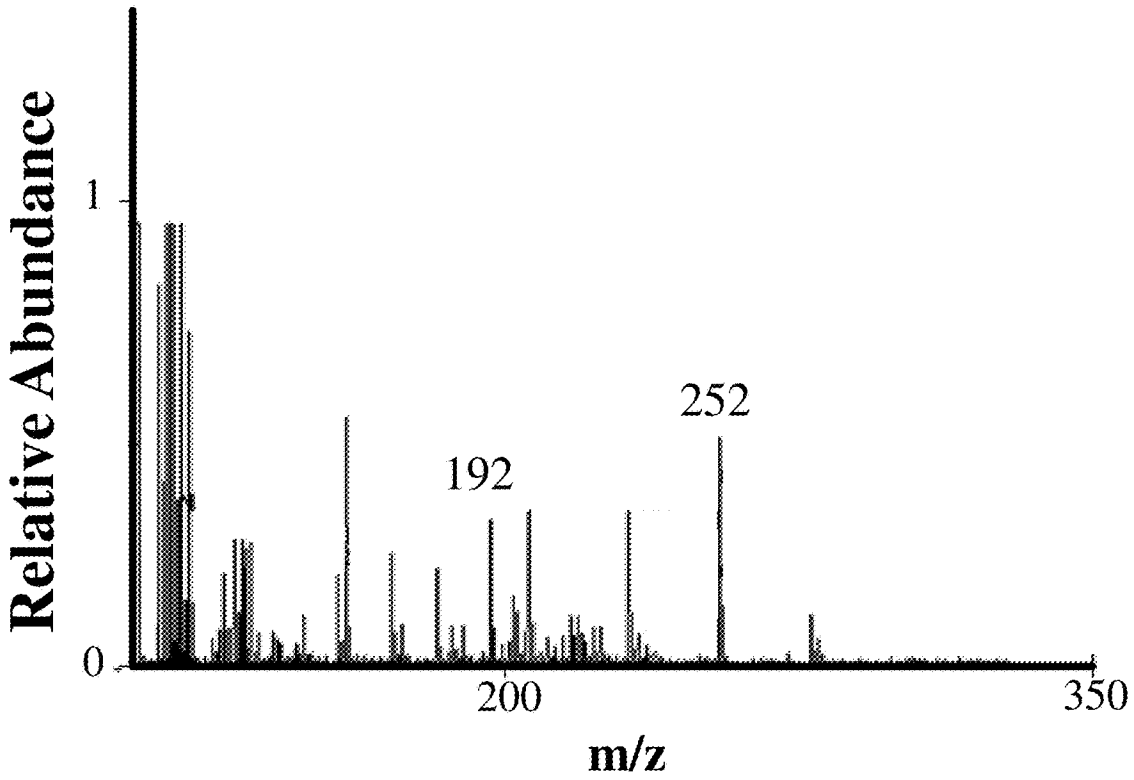
FIG. 2B shows a dopant-assisted argon DART mass spectrum for the PAH mixture at a concentration of 500 parts per billion (ppb), according to an embodiment of the invention.
Figure 2C:
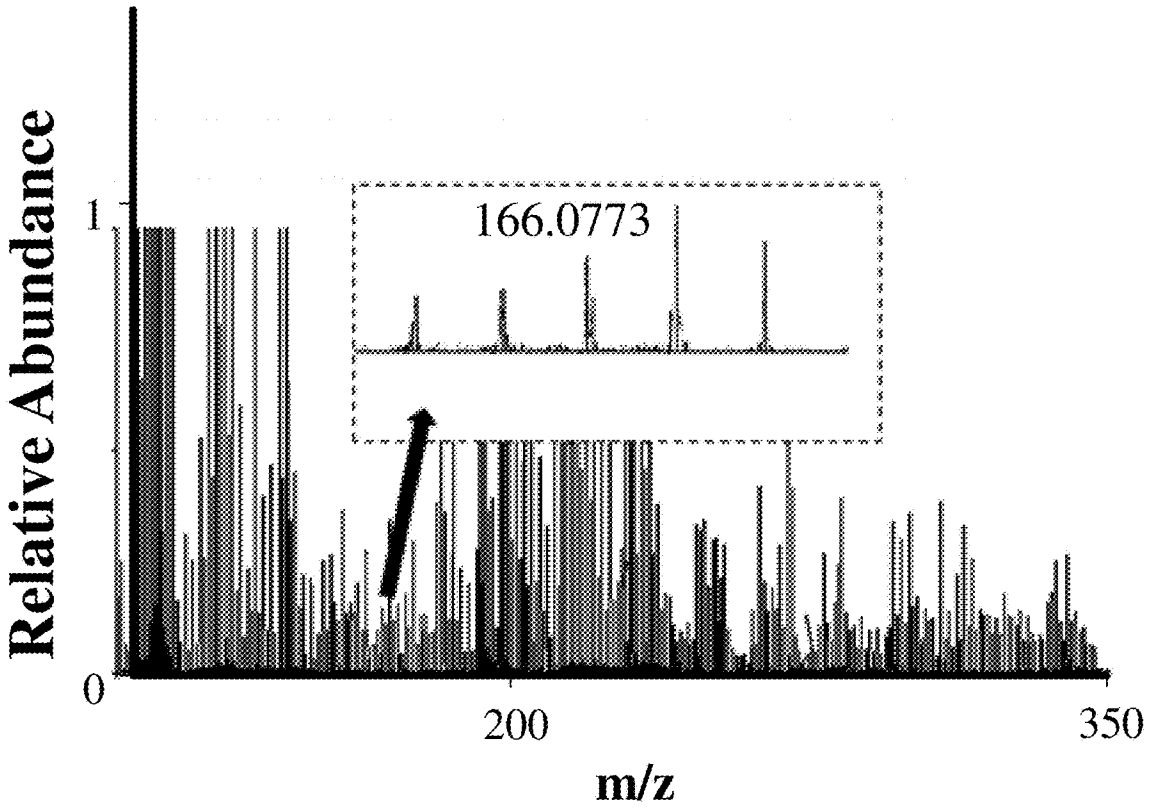
FIG. 2C shows a dopant-assisted argon DART mass spectrum for the PAH mixture at a concentration of 5 ppb, where the inset shows the fluorene molecular ion resolved from background interferences, according to an embodiment of the invention.

FIG. 2A shows the dopant-assisted argon DART mass spectrum for the solution at a concentration of 10 ppm (for the components present as a single isomer), with m/z 108, 202 and 252 identified, where the m/z of the major ions observed are identified in Table VI. FIG. 2B shows the dopant-assisted argon DART mass spectrum for a concentration of 500 ppb, with m/z 192 and 252 identified, where the m/z of the major ions observed are identified in Table VII. FIG. 2C shows the mass spectrum for the 5 ppb solution, with m/z 166.0773 identified. With the exception of naphthalene, which was obscured at the 5 ppb level by an unresolved background interference at m/z 128.078, at the 5 ppb level, all of the PAHs can be detected and separated at the mass spectrometer resolving power of 10,000 full width half maximum (FWHM) from the chemical background. Naphthalene was barely detectable at 10 ppb but was clearly detected at a concentration of 50 ppb. The peak areas for all PAHs normalized to the internal standard (9-methyl anthracene) showed a linear response with the correlation coefficient $R^2$=0.99 up to a concentration of 5 ppm.

Example 3

Figure 3A:
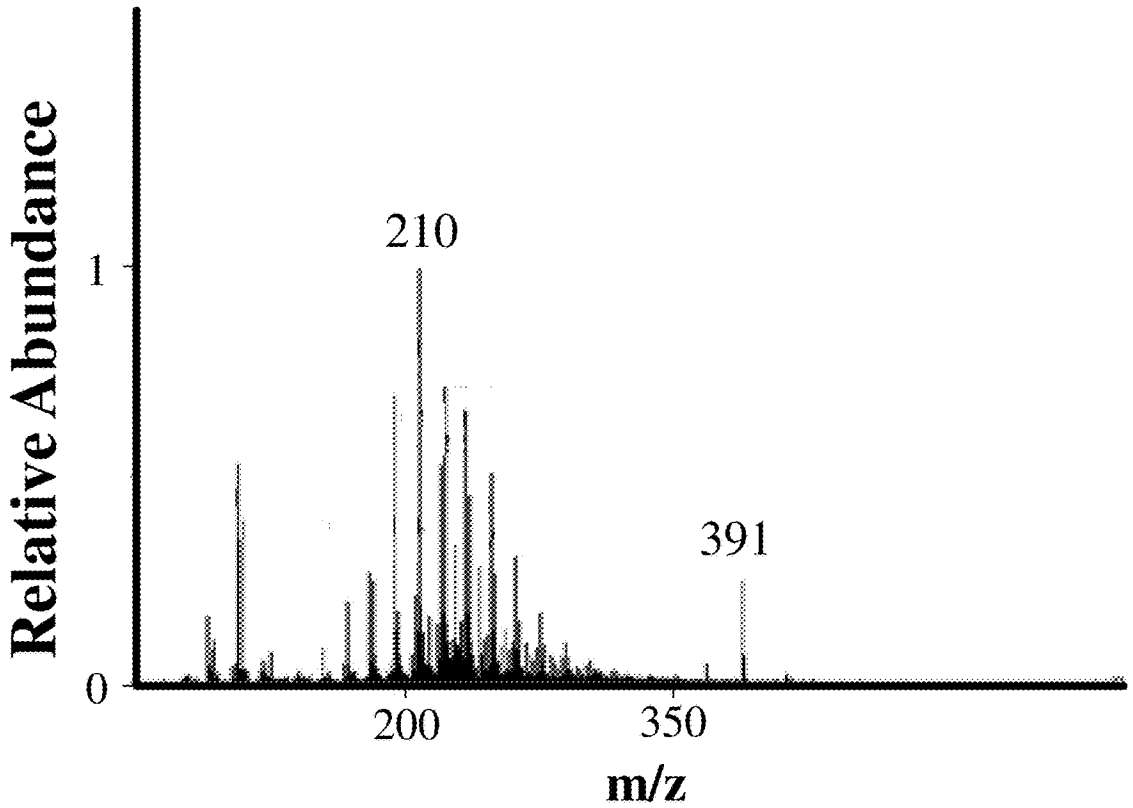
FIG. 3A shows a mass spectrum of diesel fuel analyzed by dopant-assisted argon DART with the toluene/anisole dopant, according to an embodiment of the invention.

A 10 μL sample of diesel fuel purchased at a local convenience store was diluted in 1 mL of hexane. 3 μL of this hexane solution was deposited onto the sealed end of a melting point tube, and the tube was positioned in the metastable DART gas stream. FIG. 3A shows the mass spectrum obtained by using dopant-assisted argon DART with the toluene/anisole dopant solution, with m/z 210 and 391 identified, where the m/z of the major ions observed are identified in Table VIII. In various embodiments of the invention, molecular ions were observed at even-m/z peaks for aromatic species such as alkyl naphthalenes ($C_{10}H_8$+ $nCH_2$). The helium-DART analysis (FIG. 3B) of the same sample shows a more complex mass spectrum with both protonated molecules (odd-m/z peaks) and molecular ions (even-m/z peaks) as well as abundant peaks representing protonated fatty acid methyl esters (FAMES) from biodiesel species, with m/z 295 and 312 identified, where the m/z of the major ions observed are identified in Table IX. In various embodiments of the invention, the dopant-assisted argon DART mass spectra of complex mixtures are therefore easier to interpret, because of the higher selectivity which can be varied by the choice of dopants. In various embodiments of the invention, it is possible to use argon DART to obtain information on complex mixtures.

Example 4

The feasibility of obtaining negative-ion mass spectra with dopant-assisted argon DART was demonstrated for 2, 4, 6-trinitrotoluene (TNT). For this experiment, the DART exit electrode potential was set to minus fifty volts (−50V) and the mass spectrometer polarities were set to negative-ion mode by loading a previously stored negative-ion tune condition. The atmospheric pressure interface potentials (orifice-1, ring lens, and orifice-2) were set to −20V, −5V and −5V, respectively.

Electrons formed when the dopant undergoes Penning ionization are captured by the analyte and/or atmospheric oxygen. Oxygen anions can react with suitable analytes to extract a proton. The negative-ion background dopant-assisted argon DART mass spectrum observed (see FIG. 4A) also shows some ions that are commonly observed in the negative-ion helium DART background ($NO_2^-$, $C_2H_3O_2^-$, $CO_3^-$, $HCO_3^-$), a trace of $Cl^-$, and several peaks that may result from impurities in the toluene/anisole dopant mixture, with m/z 46, 60 and 121 identified, where the m/z of the major ions observed are identified in Table X.

Figure 4A:
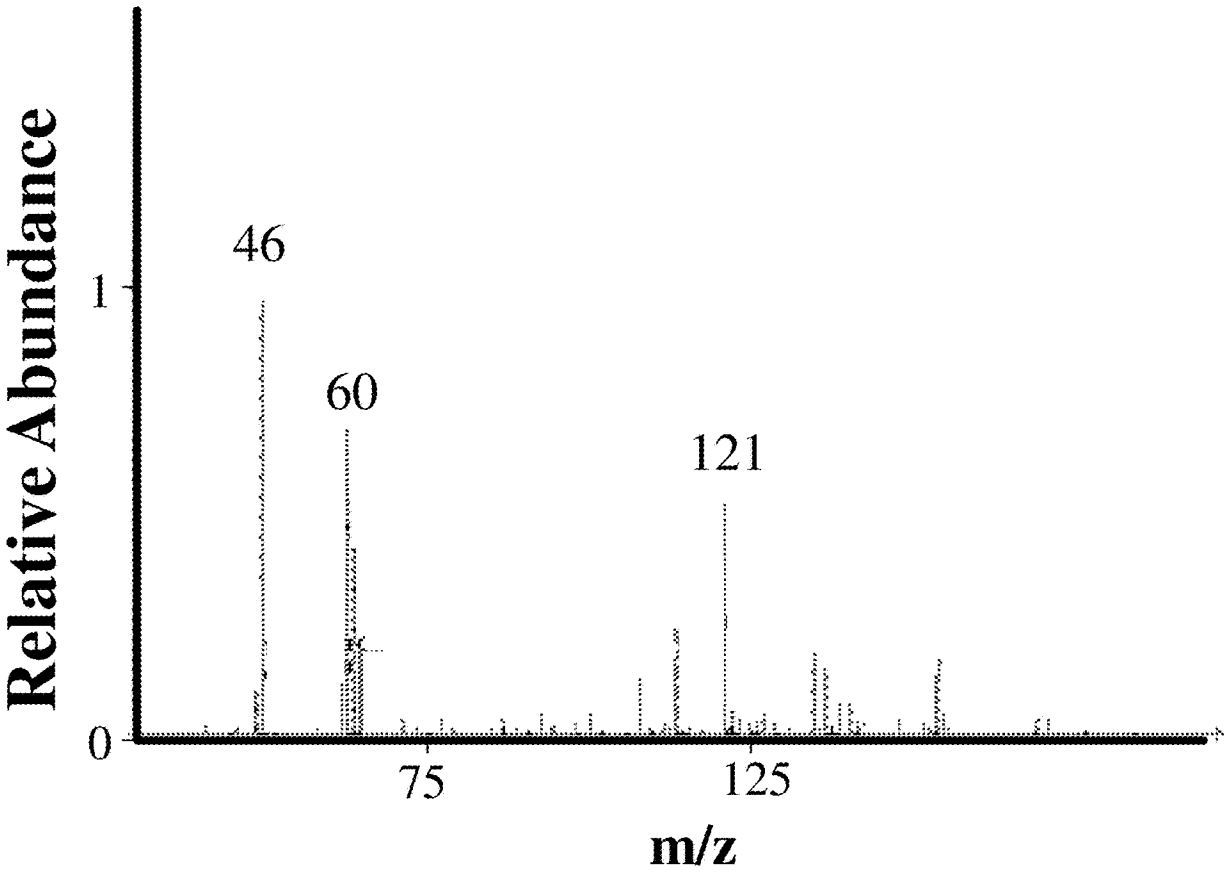
FIG. 4A shows a mass spectrum of the negative-ion background for dopant-assisted negative-ion argon DART, according to an embodiment of the invention.
Figure 4B:
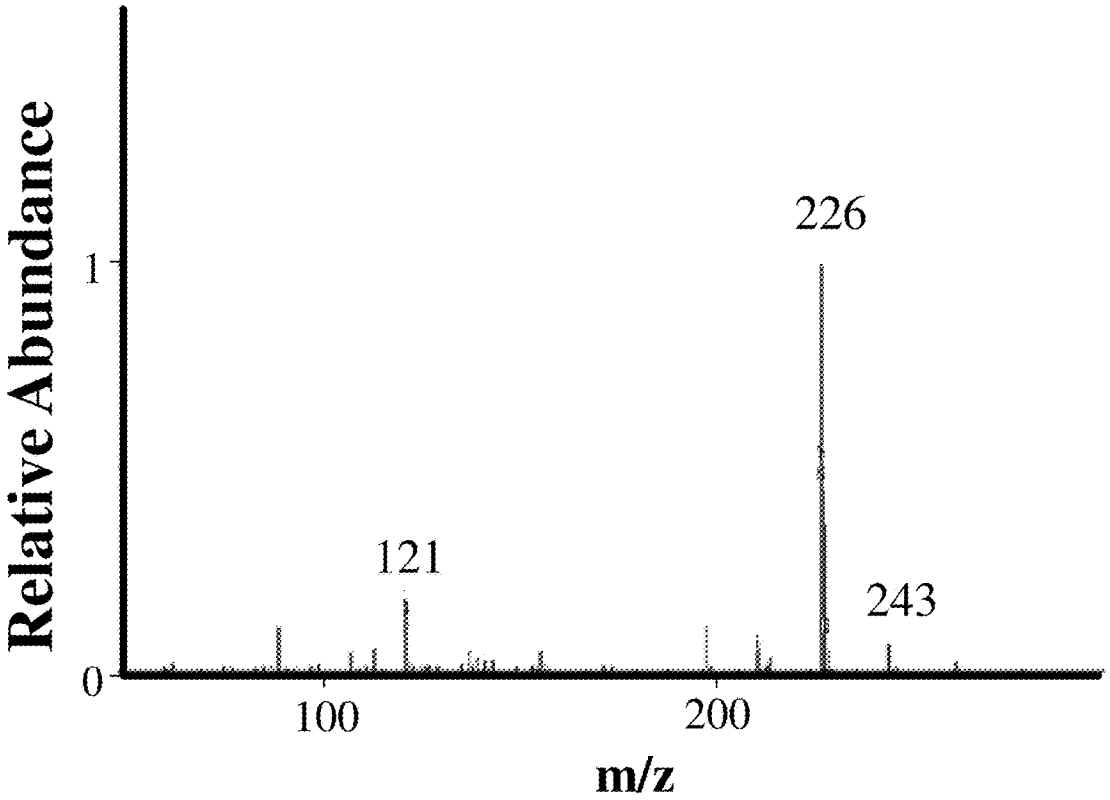
FIG. 4B shows a mass spectrum of dopant-assisted argon DART of TNT with toluene/0.5% anisole dopant, according to an embodiment of the invention.

In various embodiments of the invention, the dopant-assisted argon DART mass spectrum of TNT shown in FIG. 4B, with m/z 121, 226 and 243 identified, where the m/z of the major ions observed are identified in Table XI, is complementary to that obtained by using helium DART gas (FIG. 4C), with m/z 227 and 243 identified, where the m/z of the major ions observed are identified in Table XII. Both spectra show peaks corresponding to the molecular ion and the deprotonated molecule as well as characteristic losses of OH and NO to produce the $C_7H_5N_2O_5^-$ and $C_7H_4N_3O^-$ fragment ions respectively. A peak was observed in both mass spectra at m/z 243.014, assigned as 3-methyl-2, 4, 5-trinitrophenol, an impurity or degradation product in the sample. In various embodiments of the invention, the deprotonated molecule can be observed at a higher relative abundance in the dopant-assisted argon DART mass spectrum than in the helium DART mass spectrum.

Example 5

Δ-9 tetrahydrocannabinol (THC) and cannabidiol (CBD) are isomeric compounds that are present in marijuana. THC and CBD exhibit different electron ionization mass spectra, but the fragment-ion mass spectra produced by collision-induced fragmentation of the protonated molecules are indistinguishable.

In various embodiments of the invention, the positive-ion mass spectra observed for dopant-assisted argon DART ionization of THC (FIG. 5A), with m/z 314 and 330 identified, where the m/z of the major ions observed are identified in Table XIII, and CBD (FIG. 5B), with m/z 120, 195, 314 and 330 identified, where the m/z of the major ions observed are identified in Table XIV, with orifice 1 set to 20V are characterized by both molecular ions $M^{+}$. and protonated molecules $[M+H]^{+}$. In various embodiments of the invention, the in-source fragmentation mass spectra measured with orifice-1 set to 60V of dopant-assisted argon DART ionization of THC (FIG. 5C), with m/z 193, 231, 299 and 315 identified, where the m/z of the major ions observed are identified in Table XV, and CBD (FIG. 5D), with m/z 193, 231, 299 and 315 identified, where the m/z of the major ions observed are identified in Table XVI, are clearly different. In various embodiments of the invention, the in-source fragmentation mass spectra measured with orifice-1 set to 90V of dopant-assisted argon DART ionization of THC (FIG. 5E), with m/z 81, 123, 193, 231, 299 and 313 identified, where the m/z of the major ions observed are identified in Table XVII, and CBD (FIG. 5F), with m/z 81, 123, 174, 193, 231 and 299 identified, where the m/z of the major ions observed are identified in Table XVIII, are also very different. In various embodiments of the invention, dopant-assisted argon DART can be used to assess the relative concentrations of THC and CBD in a mixture. Methanol solutions were prepared with both THC and CBD in ratios of 1:0, 2:1, 1:1, 1:2, and 0:1, respectively. Ratios of several fragment ions were compared against THC concentration. The best linearity was obtained for the orifice-1=90V mass spectra by plotting the sum of the relative abundances of the fragments at m/z 217 and m/z 299 divided by the relative abundance of m/z 207 against percent THC in each mixture. The measurement was repeated twice, giving a correlation coefficient or $R^2$=0.995 each time. In alternative embodiments of the invention, isotopically labeled internal standards can be used for quantitative analysis.

In various embodiments of the invention, dopant-assisted DART offers an alternative method for operating a DART ion source and provides complementary information to conventional DART. Other efficient dopants include chlorobenzene, bromobenzene, 2,4-difluoroanisole, and 3-(trifluoromethyl)anisole.

The present invention is directed to a method of Direct Analysis in Real Time (DART) analysis with argon gas in the presence of dopants to the gas stream exiting the DART source. Charge-exchange and proton transfer reactions are observed with the addition of dopants such as toluene, anisole, and acetone. Polycyclic aromatic hydrocarbons can be detected as molecular ions at concentrations in the low part-per-billion range by using a solution of 0.5% anisole in toluene as a dopant. Dopant-assisted argon DART analysis of a diesel fuel sample with the same dopant mixture showed a simpler mass spectrum than obtained by using helium DART. The dopant-assisted argon DART mass spectrum was dominated by molecular ions for aromatic compounds, whereas the helium DART mass spectrum showed both molecular ions and protonated molecules. Further, positive ions produced by argon DART ionization for THC and CBD showed distinctive fragment-ion mass spectra. This differs from helium DART, where protonated THC and CBD produce identical fragment-ion mass spectra.

In the absence of a dopant, 'helium DART', 'nitrogen DART', and 'neon DART' interacting with an analyte produce predominantly protonated molecule ion species of the analyte or predominantly deprotonated molecule ion species of the analyte. Similarly, in the absence of a dopant, 'argon DART' interacting with an analyte produce predominantly protonated molecule ion species of the analyte or predominantly deprotonated molecule ion species of the analyte. Accordingly, the mass spectrum shown in FIG. 1B contains protonated acetone molecule ion species, as there was no analyte and the acetone added as a dopant has a sufficiently low ionization energy for the Ar* to form $[M+H]^{+}$ of the acetone dopant molecules.

In an embodiment of the present invention, in the presence of an efficient dopant, 'argon DART' interacting with an analyte produces predominantly molecular ion species of the analyte.

In an embodiment of the present invention, a mixture of carrier gases produce DART spectra based on the species formed with the greatest ionization efficiency. That is in an embodiment of the present invention, a mixture of helium and argon carrier gasses introduced with an efficient dopant to ionize an analyte produce a mass spectrum where the intact species is predominantly molecular ion species of the analyte.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the system includes a gas ion separator.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more ions and the plurality of ions are generated simultaneously.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where a single DART source is used to generate the one or more ions and the plurality of ions by switching between helium and argon gases.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the argon DART source includes a valve to add a dopant.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the argon DART source includes a valve to add a dopant, where the dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the argon DART source includes a valve to add a dopant, where the dopant is one or more compounds having an ionization energy lower than the internal energy of metastable argon that is suitable for one or both charge exchange and proton transfer to one or more of the plurality of analytes.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more fragment ions are generated from a negative precursor ion.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more fragment ions are formed from ion activation.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more fragment ions are formed from ion activation, where the one or more fragment ions are formed from one or more methods selected from the group consisting of collisionally activated dissociation, collision induced dissociation, in source fragmentation, ion surface collisions, ion induced dissociation, photodissociation, ion neutral collisions, ion electron collisions, ion electron collisions, electron capture dissociation and function switching.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more fragment ions are formed from ion activation, where the one or more fragment ions are generated by function switching with an orifice-1 voltage set between a lower limit of approximately 10 V and an upper limit of approximately 250 V, where approximately is ±ten (10) percent.

In an embodiment of the present invention, a system for identifying a plurality of analytes present in a sample comprises a DART source to generate one or more ions of the sample, an argon DART source to generate a plurality of ions of the sample, a mass spectrometer for measuring a first mass spectrum of one or both the one or more ions and the plurality of ions, a mass spectrometer system for generating one or more fragment ions from the plurality of ions and a mass spectrometer for measuring a second mass spectrum of the one or more fragment ions, where the one or more fragment ions are formed from ion activation, where the one or more fragment ions are generated by function switching with an orifice-1 voltage set between a lower limit of approximately 20 V and an upper limit of approximately 200 V, where approximately is ±ten (10) percent.

In an embodiment of the present invention, an ionization system for identifying a plurality of analytes present in a sample comprising a DART source, an argon DART source, a valve for introducing a dopant into the argon DART source and a mass spectrometer system for fragmenting ions generated from the sample ionized with the argon DART source.

In an embodiment of the present invention, an ionization system for identifying a plurality of analytes present in a sample comprising a DART source, an argon DART source, a valve for introducing a dopant into the argon DART source and a mass spectrometer system for fragmenting ions generated from the sample ionized with the argon DART source, where the DART source and the argon DART source simultaneously generate ions of the sample.

In an embodiment of the present invention, an ionization system for identifying a plurality of analytes present in a sample comprising a DART source, an argon DART source, a valve for introducing a dopant into the argon DART source and a mass spectrometer system for fragmenting ions generated from the sample ionized with the argon DART source, where a single DART source is used to generate ions by switching between a helium carrier gas and an argon carrier gas.

In an embodiment of the present invention, an ionization system for identifying a plurality of analytes present in a sample comprising a DART source, an argon DART source, a valve for introducing a dopant into the argon DART source and a mass spectrometer system for fragmenting ions generated from the sample ionized with the argon DART source, where the dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, an ionization system for identifying a plurality of analytes present in a sample comprising a DART source, an argon DART source, a valve for introducing a dopant into the argon DART source and a mass spectrometer system for fragmenting ions generated from the sample ionized with the argon DART source, where the dopant is selected from one or more compounds having an ionization energy lower than the internal energy of a metastable argon species formed by the argon DART source, where the metastable argon species is capable of one or both charge exchange and proton transfer to one or more of the plurality of analytes.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, where the helium DART source and argon DART source simultaneously generate ions of the sample.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, where a single DART source is used to generate ions by switching between helium and argon gases.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, further comprising generating fragment ions of one or more of the molecular ions.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, where at least the step of measuring a mass spectrum containing a molecular ion includes adding a dopant.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, where at least the step of measuring a mass spectrum containing a molecular ion includes adding a dopant, where the dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a method for determining a plurality of analytes present in a sample comprising the steps of directing a helium DART source at the sample, measuring a mass spectrum containing one or both protonated molecule ions and deprotonated molecule ions of one or more of the plurality of analytes, directing an argon DART source at the sample, measuring a mass spectrum containing a molecular ion of one or more of the plurality of analytes and combining the mass spectrum containing one or both protonated molecule ions and deprotonated molecule ions with the mass spectrum containing a molecular ion to determine the plurality of analytes present in a sample, where at least the step of measuring a mass spectrum containing a molecular ion includes adding a dopant, where the dopant is one or more compounds having an ionization energy lower than the internal energy of metastable argon that is suitable for one or both charge exchange and proton transfer to one or more of the plurality of analytes.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a mass spectrometer for recording a first mass spectrum of the ions generated from the sample, a mass spectrometer system for fragmenting intact molecular ions and a mass spectrometer for recording a second mass spectrum of one or more fragment ions.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a mass spectrometer for recording a first mass spectrum of the ions generated from the sample, a mass spectrometer system for fragmenting intact molecular ions and a mass spectrometer for recording a second mass spectrum of one or more fragment ions, where the carrier gas is argon, where the dopant is selected from one or more compounds having an ionization energy lower than the internal energy of a metastable argon species formed from the carrier gas, where the metastable argon species is capable of one or both charge exchange and proton transfer to one or more of the plurality of analytes.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a mass spectrometer for recording a first mass spectrum of the ions generated from the sample, a mass spectrometer system for fragmenting intact molecular ions and a mass spectrometer for recording a second mass spectrum of one or more fragment ions, where the dopant is selected from one or more compounds having an ionization energy lower than the internal energy of a metastable species formed from the carrier gas that is suitable for one or both charge exchange and proton transfer to one or more of the plurality of analytes.

In an embodiment of the present invention, a system for identifying a plurality of analytes present in a sample comprises a DART source with a carrier gas selected from the group consisting of helium, nitrogen and neon to generate ions of the sample, an argon DART source with an argon carrier gas and including a valve to add a dopant to the argon carrier gas to generate ions of the sample, a mass spectrometer for measuring a first mass spectrum of the ions generated from the sample, a mass spectrometer system for fragmenting intact ions generated of the sample ionized with the argon DART source and a mass spectrometer for measuring a second mass spectra of the one or more fragment ions.

In an embodiment of the present invention, a system for identifying a plurality of analytes present in a sample comprises a DART source with a carrier gas selected from the group consisting of helium, nitrogen and neon to generate ions of the sample, an argon DART source with an argon carrier gas and including a valve to add a dopant to the argon carrier gas to generate ions of the sample, a mass spectrometer for measuring a first mass spectrum of the ions generated from the sample, a mass spectrometer system for fragmenting intact ions generated of the sample ionized with the argon DART source and a mass spectrometer for measuring a second mass spectra of the one or more fragment ions, where the system includes a gas ion separator.

In an embodiment of the present invention, a system for identifying a plurality of analytes present in a sample comprises a DART source with a carrier gas selected from the group consisting of helium, nitrogen and neon to generate ions of the sample, an argon DART source with an argon carrier gas and including a valve to add a dopant to the argon carrier gas to generate ions of the sample, a mass spectrometer for measuring a first mass spectrum of the ions generated from the sample, a mass spectrometer system for fragmenting intact ions generated of the sample ionized with the argon DART source and a mass spectrometer for measuring a second mass spectra of the one or more fragment ions, where the dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a system for identifying a plurality of analytes present in a sample comprises a DART source with a carrier gas selected from the group consisting of helium, nitrogen and neon to generate ions of the sample, an argon DART source with an argon carrier gas and including a valve to add a dopant to the argon carrier gas to generate ions of the sample, a mass spectrometer for measuring a first mass spectrum of the ions generated from the sample, a mass spectrometer system for fragmenting intact ions generated of the sample ionized with the argon DART source and a mass spectrometer for measuring a second mass spectra of the one or more fragment ions, where the dopant is selected from one or more compounds having an ionization energy lower than the internal energy of a metastable argon species formed by the argon DART source, where the metastable argon species is capable of one or both charge exchange and proton transfer to one or more of the plurality of analytes.

In an embodiment of the present invention, a system for identifying a plurality of analytes present in a sample comprises a first DART source to generate ions of the sample, a second DART source using helium carrier gas to generate ions of the sample, where a dopant is contacted with the helium carrier gas, a mass spectrometer for measuring mass spectra of the ions generated from the sample, a mass spectrometer system for fragmenting intact ions generated of the sample ionized with the second DART source and a mass spectrometer for measuring a mass spectrum of the one or more fragment ions.

In an embodiment of the present invention, a system for identifying a plurality of analytes present in a sample comprises a first DART source to generate ions of the sample, a second DART source using helium carrier gas to generate ions of the sample, where a dopant is contacted with the helium carrier gas, a mass spectrometer for measuring mass spectra of the ions generated from the sample, a mass spectrometer system for fragmenting intact ions generated of the sample ionized with the second DART source and a mass spectrometer for measuring a mass spectrum of the one or more fragment ions, where the system further comprises a gas ion separator.

In an embodiment of the present invention, a system for identifying a plurality of analytes present in a sample comprises a first DART source to generate ions of the sample, a second DART source using helium carrier gas to generate ions of the sample, where a dopant is contacted with the helium carrier gas, a mass spectrometer for measuring mass spectra of the ions generated from the sample, a mass spectrometer system for fragmenting intact ions generated of the sample ionized with the second DART source and a mass spectrometer for measuring a mass spectrum of the one or more fragment ions, where the dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a system for identifying a plurality of analytes present in a sample comprises a first DART source to generate ions of the sample, a second DART source using helium carrier gas to generate ions of the sample, where a dopant is contacted with the helium carrier gas, a mass spectrometer for measuring mass spectra of the ions generated from the sample, a mass spectrometer system for fragmenting intact ions generated of the sample ionized with the second DART source and a mass spectrometer for measuring a mass spectrum of the one or more fragment ions, where the dopant is one or more compounds having an ionization energy lower than the internal energy of a metastable species formed from the helium carrier gas that is suitable for one or both charge exchange and proton transfer to one or more of the plurality of analytes.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a first mass filter for recording a first mass spectrum of the ions generated from the sample, a mass spectrometer system for fragmenting intact molecular ions and a second mass filter for recording a second mass spectrum of one or more fragment ions.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a first mass filter for recording a first mass spectrum of the ions generated from the sample, a mass spectrometer system for fragmenting intact molecular ions and a second mass filter for recording a second mass spectrum of one or more fragment ions, where the carrier gas is argon, where the dopant is selected from one or more compounds having an ionization energy lower than the internal energy of a metastable argon species formed from the carrier gas, where the metastable argon species is capable of one or both charge exchange and proton transfer to one or more of the plurality of analytes.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a first mass filter for recording a first mass spectrum of the ions generated from the sample, a mass spectrometer system for fragmenting intact molecular ions and a second mass filter for recording a second mass spectrum of one or more fragment ions, where the dopant is selected from one or more compounds having an ionization energy lower than the internal energy of a metastable species formed from the carrier gas that is suitable for one or both charge exchange and proton transfer to one or more of the plurality of analytes.

In an embodiment of the present invention, a system for identifying a plurality of analytes present in a sample comprises a source to generate predominantly protonated molecule ions of the sample, a source including a carrier gas and a dopant to generate predominantly molecular ions of the sample, a first mass filter for recording a first mass spectrum of the ions generated from the sample, a mass spectrometer system for fragmenting intact molecular ions and a second mass filter for recording a second mass spectrum of one or more fragment ions, where the mass spectrometer system is an ion trap and the ion trap generates the first mass filter and the second mass filter.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions.

In an embodiment of the present invention, a system comprises a conventional DART source to generate a first plurality of ions of a sample, an argon DART source to generate a second plurality of ions of the sample, a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, and a gas ion separator.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the first plurality of ions and the second plurality of ions are generated simultaneously.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the argon DART source comprises a conventional DART source adapted to generate an argon carrier gas.

In an embodiment of the present invention, a system comprises a conventional DART source to generate a first plurality of ions of a sample, an argon DART source to generate a second plurality of ions of the sample, a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, and a valve to introduce an efficient dopant.

In an embodiment of the present invention, a system comprises a conventional DART source to generate a first plurality of ions of a sample, an argon DART source to generate a second plurality of ions of the sample, a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, and a valve to introduce an efficient dopant, where the efficient dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a system comprises a conventional DART source to generate a first plurality of ions of a sample, an argon DART source to generate a second plurality of ions of the sample, a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, and a valve to introduce an efficient dopant, where the efficient dopant is one or more compounds having an ionization energy lower than the internal energy of metastable argon that is suitable for one or both charge exchange and proton transfer to one or more of the plurality of analytes.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the one or more fragment ions are generated from a negative precursor ion.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the one or more fragment ions are formed from ion activation.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the one or more fragment ions are formed from ion activation, where the one or more fragment ions are formed from one or more methods selected from the group consisting of collisionally activated dissociation, collision induced dissociation, in source fragmentation, ion surface collisions, ion induced dissociation, photodissociation, ion neutral collisions, ion electron collisions, ion electron collisions, electron capture dissociation and function switching.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the one or more fragment ions are formed from ion activation, where the one or more fragment ions are generated by function switching with an orifice-1 voltage set between a lower limit of approximately 10 V and an upper limit of approximately 250 V.

In an embodiment of the present invention, a system comprises a conventional DART source to generate a first plurality of ions of a sample, an argon DART source to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the one or more fragment ions are formed from ion activation, where the one or more fragment ions are generated by function with an orifice-1 voltage set between a lower limit of approximately 30 V and an upper limit of approximately 200 V.

In an embodiment of the present invention, a method comprises directing a conventional DART source at a sample made up of a plurality of analytes to form one or both positive ions and negative ions of the plurality of analytes, measuring a first mass spectrum of the first plurality of analytes, directing an argon DART source at the sample to form molecular ions of one or more of the plurality of analytes, measuring a second mass spectrum of the second plurality of analytes formed, and combining the first mass spectrum and the second mass spectrum to determine the plurality of analytes present in the sample.

In an embodiment of the present invention, a method comprises directing a conventional DART source at a sample made up of a plurality of analytes to form one or both positive ions and negative ions of the plurality of analytes, measuring a first mass spectrum of the first plurality of analytes, directing an argon DART source at the sample to form molecular ions of one or more of the plurality of analytes, measuring a second mass spectrum of the second plurality of analytes formed, and combining the first mass spectrum and the second mass spectrum to determine the plurality of analytes present in the sample, where the conventional DART source and argon DART source simultaneously generate ions of the sample.

In an embodiment of the present invention, a method comprises directing a conventional DART source at a sample made up of a plurality of analytes to form one or both positive ions and negative ions of the plurality of analytes, measuring a first mass spectrum of the first plurality of analytes, directing an argon DART source at the sample to form molecular ions of one or more of the plurality of analytes, measuring a second mass spectrum of the second plurality of analytes formed, and combining the first mass spectrum and the second mass spectrum to determine the plurality of analytes present in the sample, where the argon DART source comprises a conventional DART source adapted to generate an argon carrier gas.

In an embodiment of the present invention, a method comprises directing a conventional DART source at a sample made up of a plurality of analytes to form one or both positive ions and negative ions of the plurality of analytes, measuring a first mass spectrum of the first plurality of analytes, directing an argon DART source at the sample to form molecular ions of one or more of the plurality of analytes, measuring a second mass spectrum of the second plurality of analytes formed, combining the first mass spectrum and the second mass spectrum to determine the plurality of analytes present in the sample, and generating fragment ions of the molecular ions.

In an embodiment of the present invention, a method comprises directing a conventional DART source at a sample made up of a plurality of analytes to form one or both positive ions and negative ions of the plurality of analytes, measuring a first mass spectrum of the first plurality of analytes, adding an efficient dopant, directing an argon DART source at the sample to form ions of the dopant to generate ions of one or more of the plurality of analytes, measuring a second mass spectrum of the second plurality of analytes formed, and combining the first mass spectrum and the second mass spectrum to determine the plurality of analytes present in the sample.

In an embodiment of the present invention, a method comprises directing a conventional DART source at a sample made up of a plurality of analytes to form one or both positive ions and negative ions of the plurality of analytes, measuring a first mass spectrum of the first plurality of analytes, adding an efficient dopant, directing an argon DART source at the sample to form ions of the dopant to generate ions of one or more of the plurality of analytes, measuring a second mass spectrum of the second plurality of analytes formed, and combining the first mass spectrum and the second mass spectrum to determine the plurality of analytes present in the sample, where the efficient dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a method comprises directing a conventional DART source at a sample made up of a plurality of analytes to form one or both positive ions and negative ions of the plurality of analytes, measuring a first mass spectrum of the first plurality of analytes, adding an efficient dopant, directing an argon DART source at the sample to form ions of the dopant to generate ions of one or more of the plurality of analytes, measuring a second mass spectrum of the second plurality of analytes formed, and combining the first mass spectrum and the second mass spectrum to determine the plurality of analytes present in the sample, where the efficient dopant is one or more compounds having an ionization energy lower than the internal energy of metastable argon that is suitable for one or both charge exchange and proton transfer to one or more of the plurality of analytes.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form intact ions of the sample, measuring a second mass spectrum of the ions of the sample formed, and combining the first mass spectrum and the second mass spectrum to determine one or more characteristic of the plurality of analytes present in the sample.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form intact ions of the sample, measuring a second mass spectrum of the ions of the sample formed, and combining the first mass spectrum and the second mass spectrum to determine one or more characteristic of the plurality of analytes present in the sample, where the first carrier gas and the dopant ions simultaneously generate ions of the sample.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form intact ions of the sample, measuring a second mass spectrum of the ions of the sample formed, and combining the first mass spectrum and the second mass spectrum to determine one or more characteristic of the plurality of analytes present in the sample, where the argon DART source comprises a conventional DART source adapted to generate an Ar* carrier gas.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form a plurality of intact ions of the sample, measuring a second mass spectrum of the ions of the sample formed, and combining the first mass spectrum and the second mass spectrum to determine one or more characteristic of the plurality of analytes present in the sample, further comprising generating fragment ions of the plurality of intact ions.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form intact ions of the sample, measuring a second mass spectrum of the ions of the sample formed, and combining the first mass spectrum and the second mass spectrum to determine one or more characteristic of the plurality of analytes present in the sample, where the efficient dopant is one or more compounds selected from the group consisting of anisole, toluene, acetone, chlorobenzene, bromobenzene, 2, 4-difluoroanisole, and 3-(trifluoromethyl)anisole.

In an embodiment of the present invention, a method comprises directing a first carrier gas from a conventional DART source at a sample made up of a plurality of analytes to form one or both positive ions and negative ions of the sample, measuring a first mass spectrum of the one or both positive ions and negative ions of the sample formed, introducing an efficient dopant, generating a plurality of dopant ions from the interaction of the efficient dopant with a second carrier gas of an argon DART source, directing the plurality of dopant ions at the sample to form intact ions of the sample, measuring a second mass spectrum of the ions of the sample formed, and combining the first mass spectrum and the second mass spectrum to determine one or more characteristic of the plurality of analytes present in the sample, where the efficient dopant is one or more compounds having an ionization energy lower than the internal energy of metastable argon that is suitable for one or both charge exchange and proton transfer to one or more of the plurality of analytes.

In an embodiment of the present invention, a system comprises a conventional DART source to generate a carrier gas stream contacting a sample to generate a first plurality of ions of the sample, an dopant DART source to generate a dopant carrier gas contacting the sample; a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions.

TABLE 1

Components in the PAH Native Standard Mixture ES-5438. Each component was present at a concentration of 200 pg/mL (200 ppm) in the standard solution.

| Name | Composition | m/z |
|---|---|---|
| Anisole[1] | $C_7H_8O$ | 108.05751 |
| Naphthalene | $C_{10}H_8$ | 128.0626 |
| Acenaphthylene | $C_{12}H_8$ | 152.0626 |
| Acenaphthene | $C_{12}H_{10}$ | 154.07825 |
| Fluorene | $C_{13}H_{10}$ | 166.07825 |
| Phenanthrene | $C_{14}H_{10}$ | 178.07825 |
| Anthracene, 9-methyl-[2] | $C_{15}H_{12}$ | 192.0939 |
| Fluoranthene | $C_{16}H_{10}$ | 202.07825 |
| Pyrene | $C_{16}H_{10}$ | 202.07825 |
| Chrysene | $C_{18}H_{12}$ | 228.0939 |
| Benz[a]anthracene | $C_{18}H_{12}$ | 228.0939 |
| Benzo[a]pyrene | $C_{20}H_{12}$ | 252.0939 |
| Benzo[b]fluoranthene | $C_{20}H_{12}$ | 252.0939 |
| Benzo[k]fluoranthene | $C_{20}H_{12}$ | 252.0939 |
| Perylene | $C_{20}H_{12}$ | 252.0939 |
| Benzo[ghi]perylene | $C_{22}H_{12}$ | 276.0939 |
| Indeno[1,2,3-cd]pyrene | $C_{22}H_{12}$ | 276.0939 |
| Dibenz(a,h)anthracene[3] | $C_{22}H_{14}$ | 278.10955 |

[1]Dopant;
[2]Internal standard;
[3]Unlisted component.

TABLE II

Major Ions Observed in FIG. 1B.

| Origin | Formula | Assign | Calc.[a] | m/z[b] | δ[c] | Intensity |
|---|---|---|---|---|---|---|
| Acetone | C3H6O | M + H | 59.05050 | 59.04969 | −0.81 | 100.000 |
| Acetone | C3H6O | M + NH4 | 76.07440 | 76.07623 | 1.83 | 1.390 |
| Acetone | C3H6O | 2M + H | 117.08990 | 117.09155 | 1.65 | 28.360 |

[a]Calculated mass;
[b]measured mass to charge;
[c]difference in millimass units.

TABLE III

Major Ions Observed in FIG. 1C.

| Origin | Formula | Assign | Calc.[a] | m/z[b] | δ[c] | Intensity |
|---|---|---|---|---|---|---|
| Acetone | C3H6O | M + H | 59.05200 | 59.04969 | −2.31 | 2. |
| C5H9 | C5H9 | | 69.07160 | 69.07043 | −1.17 | 5.030 |
| Benzene | C6H6 | M + H | 79.05450 | 79.05478 | 0.28 | 1.230 |
| Toluene | C7H8 | | 92.06230 | 92.06260 | 0.30 | 100.000 |
| Toluene | C7H8 | M + H | 93.07090 | 93.07043 | −0.47 | 51.480 |
| Anisole | C7H8O | | 108.05790 | 108.05751 | −0.39 | 14.030 |
| C8H12 | C8H12 | | 108.09460 | 108.09390 | −0.70 | 1.000 |
| Anisole | C7H8O | M + H | 109.06420 | 109.06534 | 1.13 | 1.960 |
| C8H12 | C8H12 | M + H | 109.10270 | 109.10173 | −0.97 | 16.670 |
| C7H12O2 | C7H12O2 | M + H | 129.09081 | 129.09156 | 0.75 | 5.460 |

TABLE IV

Major Ions Observed in FIG. 1D.

| Origin | Formula | Calc.[a] | m/z[b] | δ[c] | Intensity |
|---|---|---|---|---|---|
| Benzene | C6H6 | 78.04360 | 78.04695 | 3.35 | 1.340 |
| Toluene | C7H8 | 92.05970 | 92.06260 | 2.90 | 1.390 |
| Phenol | C6H6O | 94.03970 | 94.04186 | 2.16 | 5.640 |
| Anisole | C7H8O | 108.05750 | 108.05751 | 0.01 | 100.000 |
| C8H12 | C8H12 | 108.09120 | 108.09390 | 2.70 | 1.910 |
| C8H10O | C8H10O | 122.07390 | 122.07317 | −0.73 | 2.420 |
| C9H12O | C9H12O | 136.08980 | 136.08882 | −0.98 | 1.240 |
| C14H14O | C14H14O | 198.10420 | 198.10447 | 0.27 | 1.530 |

[a]Calculated mass;
[b]measured mass to charge;
[c]difference in millimass units.

TABLE V

Figure 1E:
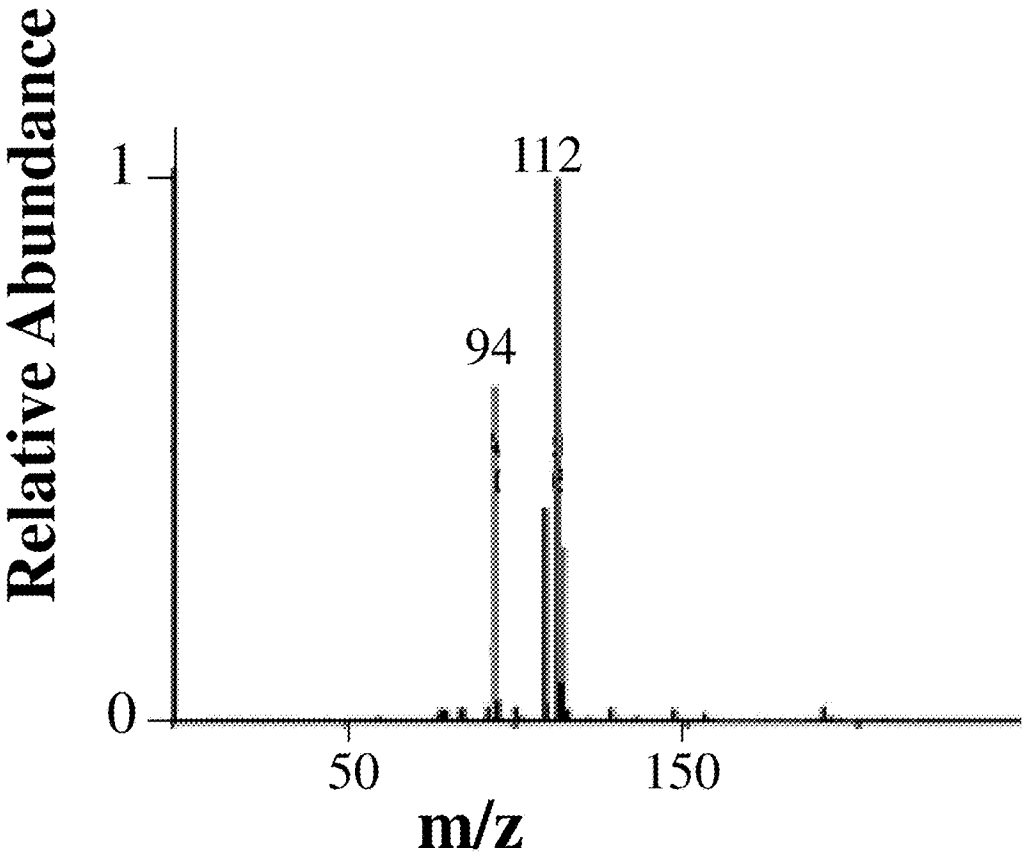
FIG. 1E shows a background positive-ion argon DART mass spectrum with a chlorobenzene dopant, according to an embodiment of the invention.

Major Ions Observed in FIG. 1E.

| Origin | Formula | Calc.[a] | m/z[b] | δ[c] | Intensity |
|---|---|---|---|---|---|
| Benzene | C6H6 | 78.04250 | 78.04695 | 4.45 | 2.370 |
| Toluene | C7H8 | 92.06180 | 92.06260 | 0.80 | 2.750 |
| Phenol | C6H6O | 94.04060 | 94.04186 | 1.26 | 61.840 |
| Anisole | C7H8O | 108.05750 | 108.05751 | 0.01 | 39.260 |
| Chlorobenzene | C6H5Cl | 112.00850 | 112.00798 | −0.52 | 100.000 |

[a]Calculated mass;
[b]measured mass to charge;
[c]difference in millimass units.

TABLE VI

Major Ions Observed in FIG. 2A.

| Origin | Formula | Assign | Calc.[a] | m/z[b] | δ[c] | Intensity |
|---|---|---|---|---|---|---|
| Anisole | C7H8O | | 108.05750 | 108.05751 | 0.01 | 100.000 |
| Naphthalene | C10H8 | | 128.06290 | 128.06260 | −0.30 | 4.980 |
| Acenaphthylene | C12H8 | | 152.06300 | 152.06260 | −0.40 | 4.930 |
| Acenaphthene | C12H10 | | 154.07800 | 154.07825 | 0.25 | 33.440 |
| Fluorene | C13H10 | | 166.07719 | 166.07825 | 1.06 | 8.100 |
| Phenanthrene | C14H10 | | 178.07651 | 178.07825 | 1.74 | 9.490 |
| Anthracene(9-methyl) | C15H12 | | 192.09270 | 192.09390 | 1.20 | 40.000 |
| Phenanthrene | C14H10 | M + NH4 | 196.11610 | 196.11262 | −3.48 | 0.070 |
| Fluoranthene | C16H10 | | 202.07690 | 202.07825 | 1.35 | 71.390 |
| Pyrene | C16H10 | | 202.07690 | 202.07825 | 1.35 | 71.390 |
| Benz[a]anthracene | C18H12 | | 228.09219 | 228.09390 | 1.71 | 54.240 |
| Chrysene | C18H12 | | 228.09219 | 228.09390 | 1.71 | 54.240 |
| Benzo[k]fluoranthene | C20H12 | | 252.09419 | 252.09390 | −0.29 | 94.970 |
| Benzo[a]pyrene | C20H12 | | 252.09419 | 252.09390 | −0.29 | 94.970 |
| Benzo[b]fluoranthene | C20H12 | | 252.09419 | 252.09390 | −0.29 | 94.970 |
| Perylene | C20H12 | | 252.09419 | 252.09390 | −0.29 | 94.970 |
| Indeno[1,2,3-cd]pyrene | C22H12 | | 276.09451 | 276.09390 | −0.61 | 16.000 |
| Benzo[ghi]perylene | C22H12 | | 276.09451 | 276.09390 | −0.61 | 16.000 |
| Dibenz(a,h)anthracene | C22H14 | | 278.10941 | 278.10955 | 0.14 | 7.010 |
| Dibenz(a,h)anthracene. | C22H14 | M + NH4 | 296.14441 | 296.14392 | −0.48 | 0.040 |

[a]Calculated mass;
[b]measured mass to charge;
[c]difference in millimass units.

TABLE VII

Major Ions Observed in FIG. 2B.

| Origin | Formula | Calc.[a] | m/z[b] | δ[c] | Intensity |
|---|---|---|---|---|---|
| Anisole | C7H8O | 108.05620 | 108.05751 | 1.31 | 100.000 |
| Naphthalene | C10H8 | 128.06281 | 128.06260 | −0.21 | 2.620 |
| Acenaphthylene | C12H8 | 152.06149 | 152.06260 | 1.11 | 2.020 |
| Acenaphthene | C12H10 | 154.07790 | 154.07825 | 0.35 | 5.600 |
| Fluorene | C13H10 | 166.07710 | 166.07825 | 1.15 | 2.500 |
| Phenanthrene | C14H10 | 178.07629 | 178.07825 | 1.96 | 2.160 |
| Anthracene, 9-methyl- | C15H12 | 192.09261 | 192.09390 | 1.29 | 3.270 |
| Fluoranthene | C16H10 | 202.07671 | 202.07825 | 1.54 | 3.480 |
| Pyrene | C16H10 | 202.07671 | 202.07825 | 1.54 | 3.480 |
| Benz[a]anthracene | C18H12 | 228.09210 | 228.09390 | 1.80 | 3.420 |
| Chrysene | C18H12 | 228.09210 | 228.09390 | 1.80 | 3.420 |
| Benzo-[k]fluoranthene | C20H12 | 252.09390 | 252.09390 | 0.00 | 5.140 |
| Benzo[a]pyrene | C20H12 | 252.09390 | 252.09390 | 0.00 | 5.140 |
| Benzo-[b]fluoranthene | C20H12 | 252.09390 | 252.09390 | 0.00 | 5.140 |
| Perylene | C20H12 | 252.09390 | 252.09390 | 0.00 | 5.140 |
| Indeno-[1,2,3-cd]pyrene | C22H12 | 276.09421 | 276.09390 | −0.31 | 1.120 |
| Benzo-[ghi]perylene | C22H12 | 276.09421 | 276.09390 | −0.31 | 1.120 |
| Dibenz-(a,h)anthracene | C22H14 | 278.10889 | 278.10955 | 0.66 | 0.550 |

[a]Calculated mass;
[b]measured mass to charge;
[c]difference in millimass units.

TABLE VIII

Major Ions Observed in FIG. 3A.

| Origin | Formula | Calc.[a] | m/z[b] | δ[c] | Intensity |
|---|---|---|---|---|---|
| C12 H12 | C12H12 | 156.09390 | 156.09390 | 0.00 | 7.990 |
| C13 H14 | C13H14 | 170.10809 | 170.10955 | 1.46 | 19.580 |
| C14 H14 | C14H14 | 182.10831 | 182.10955 | 1.24 | 26.710 |
| C14 H16 | C14H16 | 184.12480 | 184.12520 | 0.40 | 24.740 |
| C15 H16 | C15H16 | 196.12270 | 196.12520 | 2.50 | 69.630 |
| C16 H16 | C16H16 | 208.12511 | 208.12520 | 0.09 | 20.880 |
| C16 H18 | C16H18 | 210.13960 | 210.14085 | 1.25 | 100.000 |

TABLE VIII-continued

Major Ions Observed in FIG. 3A.

| Origin | Formula | Calc.[a] | m/z[b] | δ[c] | Intensity |
|---|---|---|---|---|---|
| C16 H20 | C16H20 | 212.15520 | 212.15650 | 1.30 | 12.130 |
| C17 H18 | C17H18 | 222.14020 | 222.14085 | 0.65 | 52.610 |
| C17 H20 | C17H20 | 224.15511 | 224.15650 | 1.39 | 70.280 |
| C18 H14 | C18H14 | 230.10899 | 230.10955 | 0.56 | 33.210 |
| C18 H20 | C18H20 | 236.15669 | 236.15650 | −0.19 | 65.120 |
| C18 H22 | C18H22 | 238.17270 | 238.17215 | −0.55 | 44.860 |
| C19 H16 | C19H16 | 244.12480 | 244.12520 | 0.40 | 28.810 |
| C19 H22 | C19H22 | 250.17340 | 250.17215 | −1.25 | 50.510 |
| C19 H24 | C19H24 | 252.18739 | 252.18780 | 0.41 | 26.420 |
| C20 H24 | C20H24 | 264.18719 | 264.18780 | 0.61 | 30.450 |
| C20 H26 | C20H26 | 266.20380 | 266.20345 | −0.35 | 15.000 |
| C21 H26 | C21H26 | 278.20432 | 278.20345 | −0.87 | 17.100 |

[a]Calculated mass;
bmeasured mass to charge;
[c]difference in millimass units.

TABLE IX

Figure 3B:
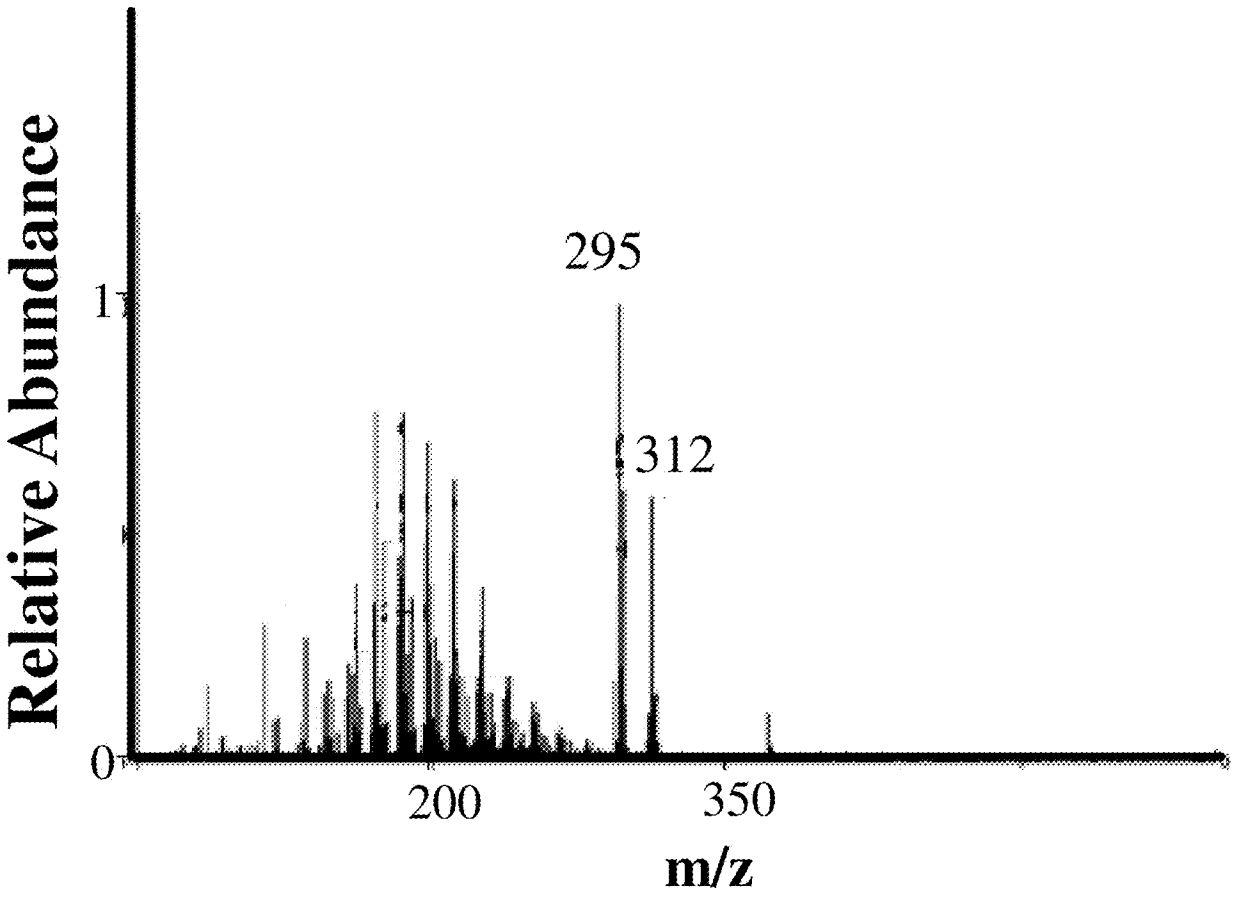
FIG. 3B shows a mass spectrum of diesel fuel analyzed by helium DART, according to an embodiment of the invention.

Major Ions Observed in FIG. 3B.

| Origin | Formula | Calc.[a] | m/z[b] | δ[c] | Intensity |
|---|---|---|---|---|---|
| C12 H12 | C12H12 | 156.09390 | 156.09390 | 0.00 | 14.279 |
| C13 H14 | C13H14 | 170.10809 | 170.10955 | 1.46 | 34.790 |
| C14 H14 | C14H14 | 182.10831 | 182.10955 | 1.24 | 30.070 |
| C14 H16 | C14H16 | 184.12480 | 184.12520 | 0.40 | 40.361 |
| C15 H16 | C15H16 | 196.12469 | 196.12520 | 0.51 | 50.950 |
| C16 H16 | C16H16 | 208.12520 | 208.12520 | 0.00 | 10.050 |
| C16 H18 | C16H18 | 210.13960 | 210.14085 | 1.25 | 45.631 |
| C16 H20 | C16H20 | 212.15511 | 212.15650 | 1.39 | 17.411 |
| C17 H18 | C17H18 | 222.14020 | 222.14085 | 0.65 | 15.591 |
| C17 H20 | C17H20 | 224.15511 | 224.15650 | 1.39 | 28.979 |
| C18 H14 | C18H14 | 230.11121 | 230.10955 | −1.66 | 6.340 |
| C18 H20 | C18H20 | 236.15680 | 236.15650 | −0.30 | 13.950 |
| C18 H22 | C18H22 | 238.17050 | 238.17215 | 1.65 | 16.090 |
| C19 H16 | C19H16 | 244.12700 | 244.12520 | −1.80 | 3.920 |
| C19 H22 | C19H22 | 250.17340 | 250.17215 | −1.25 | 9.700 |
| C19 H24 | C19H24 | 252.18739 | 252.18780 | 0.41 | 8.460 |
| C20 H24 | C20H24 | 264.18951 | 264.18780 | −1.71 | 5.680 |
| C20 H26 | C20H26 | 266.20370 | 266.20345 | −0.25 | 4.771 |
| C21 H26 | C21H26 | 278.20432 | 278.20345 | −0.87 | 3.410 |

TABLE IX-continued

Major Ions Observed in FIG. 3B.

| Origin | Formula | Calc.[a] | m/z[b] | δ[c] | Intensity |
|---|---|---|---|---|---|
| Methyl oleate | C19H36O2 | 296.26770 | 296.27153 | 3.83 | 20.670 |
| C12 H12 | C12H12 + H | 157.10181 | 157.10173 | −0.08 | 21.390 |
| C13 H14 | C13H14 + H | 171.11591 | 171.11738 | 1.47 | 78.620 |
| C14 H14 | C14H14 + H | 183.11520 | 183.11738 | 2.17 | 45.110 |
| C14 H16 | C14H16 + H | 185.13310 | 185.13303 | −0.08 | 76.920 |
| C15 H16 | C15H16 + H | 197.13229 | 197.13303 | 0.73 | 70.060 |
| C16 H16 | C16H16 + H | 209.13330 | 209.13303 | −0.28 | 17.561 |
| C16 H18 | C16H18 + H | 211.14830 | 211.14868 | 0.37 | 61.560 |
| C16 H20 | C16H20 + H | 213.16440 | 213.16433 | −0.07 | 21.799 |
| C17 H18 | C17H18 + H | 223.14861 | 223.14868 | 0.07 | 21.730 |
| C17 H20 | C17H20 + H | 225.16370 | 225.16433 | 0.63 | 36.611 |
| C18 H14 | C18H14 + H | 231.11740 | 231.11738 | −0.03 | 7.200 |
| C18 H20 | C18H20 + H | 237.16479 | 237.16433 | −0.47 | 18.580 |
| C18 H22 | C18H22 + H | 239.18040 | 239.17998 | −0.43 | 19.090 |
| C19 H16 | C19H16 + H | 245.13120 | 245.13303 | 1.83 | 4.529 |
| C19 H22 | C19H22 + H | 251.18060 | 251.17998 | −0.63 | 12.830 |
| C19 H24 | C19H24 + H | 253.19630 | 253.19563 | −0.68 | 10.460 |
| C20 H24 | C20H24 + H | 265.19571 | 265.19563 | −0.08 | 7.610 |
| C20 H26 | C20H26 + H | 267.21140 | 267.21128 | −0.12 | 5.709 |
| C21 H26 | C21H26 + H | 279.20990 | 279.21128 | 1.38 | 4.750 |
| Methyl linoleate | C19H34O2 + H | 295.26480 | 295.26371 | −1.10 | 100.000 |
| Methyl oleate | C19H36O2 + H | 297.27979 | 297.27936 | −0.43 | 59.260 |

[a]Calculated mass;
[b]measured mass to charge;
[c]difference in millimass units.

TABLE X

Major Ions Observed in FIG. 4A.

| Origin | Formula | Calc.[a] | m/z[b] | δ[c] | Intensity |
|---|---|---|---|---|---|
| O2 | O2 | 31.99030 | 31.98983 | −0.47 | 15.630 |
| Cl | Cl | 34.97070 | 34.96885 | −1.85 | 6.340 |
| HCO2 | HCO2 | 44.99630 | 44.99765 | 1.35 | 10.030 |
| NO2 | NO2 | 45.99170 | 45.99290 | 1.20 | 100.000 |
| C2H3O2 | C2H3O2 | 59.01450 | 59.01330 | −1.20 | 11.330 |
| CO3 | CO3 | 59.98470 | 59.98474 | 0.04 | 68.590 |
| HCO3 | HCO3 | 60.99280 | 60.99257 | −0.23 | 41.900 |
| NO3 | NO3 | 61.98840 | 61.98782 | −0.58 | 18.770 |
| C5H5O3 | C5H5O3 | 113.01860 | 113.02387 | 5.27 | 16.90 |

[a]Calculated mass;
[b]measured mass to charge;
[c]difference in millimass units.

TABLE XI

Major Ions Observed in FIG. 4B.

| Origin | Formula | Calc.[a] | m/z[b] | δ[c] | Intensity |
|---|---|---|---|---|---|
| C7H7O | C7H7O | 107.04990 | 107.04969 | −0.21 | 4.990 |
| C5H5O3 | C5H5O3 | 113.02270 | 113.02387 | 1.17 | 6.270 |
| C7H5O2 | C7H5O2 | 121.02830 | 121.02895 | 0.65 | 18.060 |
| C8H7O2 | C8H7O2 | 135.04640 | 135.04460 | −1.80 | 1.860 |
| C7H7O4 | C7H7O4—OH | 138.03081 | 138.03169 | 0.88 | 1.380 |
| C7H7O4 | C7H7O4 | 155.03709 | 155.03443 | −2.66 | 5.100 |
| TNT | C7H5N3O6—NO | 197.02110 | 197.01984 | −1.26 | 14.360 |
| TNT | C7H5N3O6—H | 210.01601 | 210.01509 | −0.92 | 5.200 |
| C7H5N3O7 | C7H5N3O7—NO | 213.01500 | 213.01476 | −0.24 | 1.970 |
| TNT | C7H5N3O6—H | 226.01140 | 226.01000 | −1.39 | 100.000 |
| TNT | C7H5N3O6 | 227.01781 | 227.01783 | 0.02 | 44.720 |
| C7H5N3O7 | C7H5N3O7 | 243.01379 | 243.01275 | −1.04 | |

[a]Calculated mass;
[b]measured mass to charge;
[c]difference in millimass units.

TABLE XII

Figure 4C:
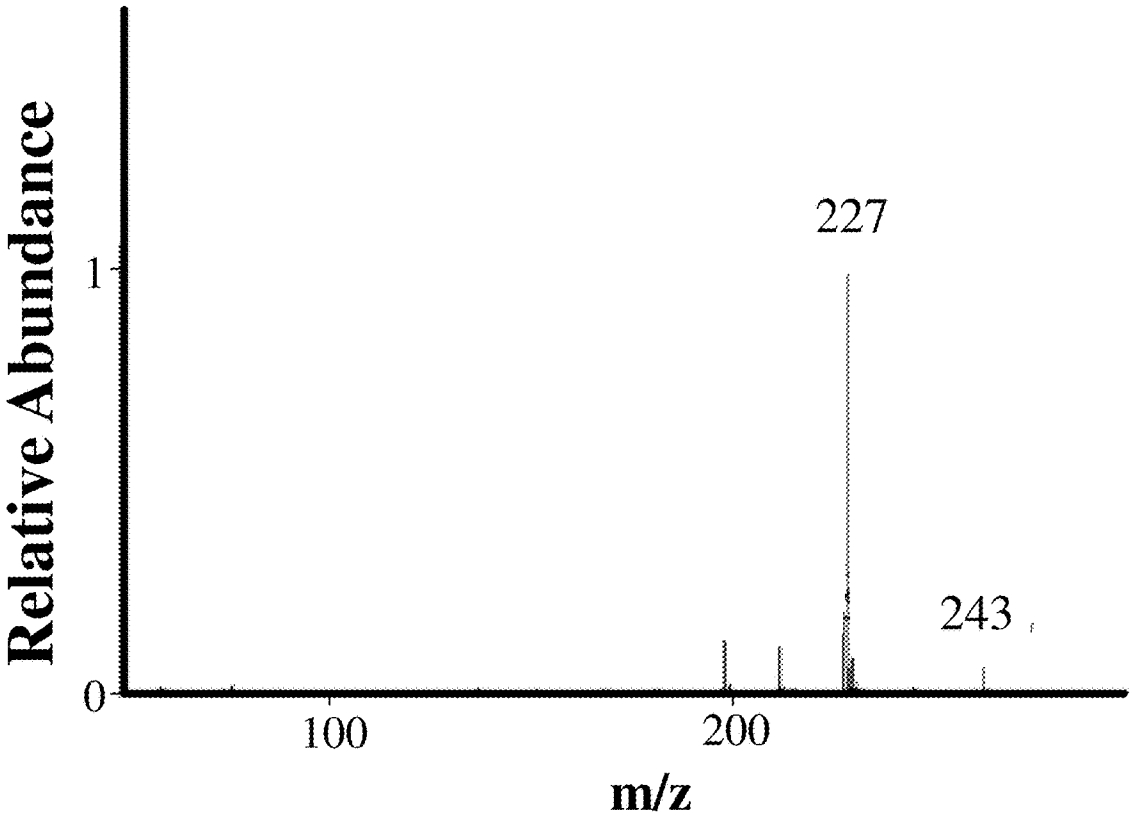
FIG. 4C shows a mass spectrum of the helium DART of TNT.

Major Ions Observed in FIG. 4C.

| Origin | Formula | Calc.[a] | m/z[b] | δ[c] | Intensity |
|---|---|---|---|---|---|
| TNT | C7H5N3O6—NO | 197.01700 | 197.01984 | 2.84 | 15.750 |
| TNT | C7H5N3O6—OH | 210.01379 | 210.01509 | 1.30 | 9.470 |
| TNT | C7H5N3O6—H | 226.00920 | 226.01000 | 0.80 | 18.860 |
| TNT | C7H5N3O6 | 227.01781 | 227.01783 | 0.02 | 100.000 |

[a]Calculated mass;
[b]measured mass to charge;
[c]difference in millimass units.

TABLE XIII

Figure 5A:
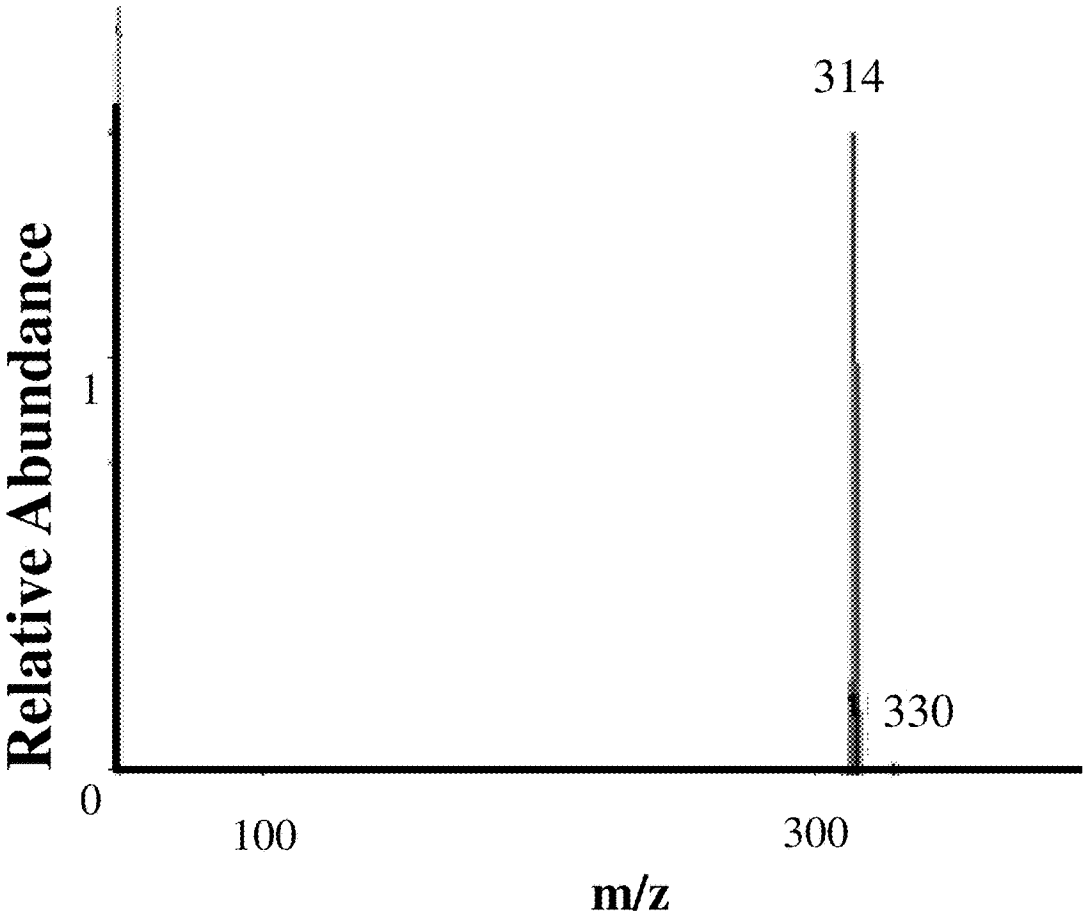
FIG. 5A shows a mass spectrum of dopant-assisted argon DART of THC with an orifice-1 voltage of 20V, according to an embodiment of the invention.

Major Ions Observed in FIG. 5A.

| Origin | Formula | Calc.[a] | m/z[b] | δ[c] | Intensity |
|---|---|---|---|---|---|
| THC | C21H30O2 | 314.22409 | 314.22458 | 0.49 | 100.000 |
| THC | C21H30O2 + H | 315.22989 | 315.23241 | 2.52 | 64.920 |

[a]Calculated mass;
[b]measured mass to charge;
[c]difference in millimass units.

TABLE XIV

Figure 5B:
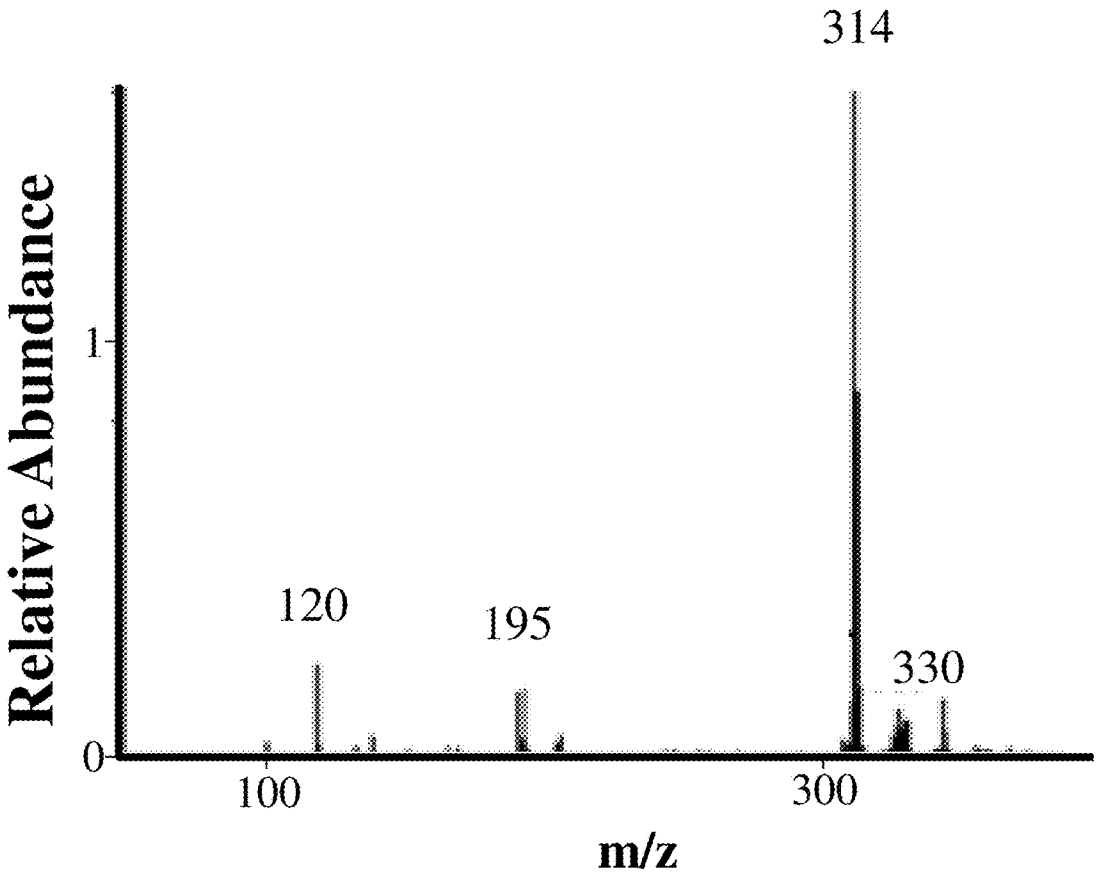
FIG. 5B shows a mass spectrum of dopant-assisted argon DART of CBD with an orifice-1 voltage of 20V, according to an embodiment of the invention.

Major Ions Observed in FIG. 5B.

| Origin | Formula | Calc.[a] | m/z[b] | δ[c] | Intensity |
|---|---|---|---|---|---|
| CBD | C21H30O2 | 314.22409 | 314.22458 | 0.49 | 100.000 |
| CBD | C21H30O2 + H | 315.22989 | 315.23241 | 2.52 | 54.650 |

[a]Calculated mass;
[b]measured mass to charge;
[c]difference in millimass units.

TABLE XV

Figure 5C:
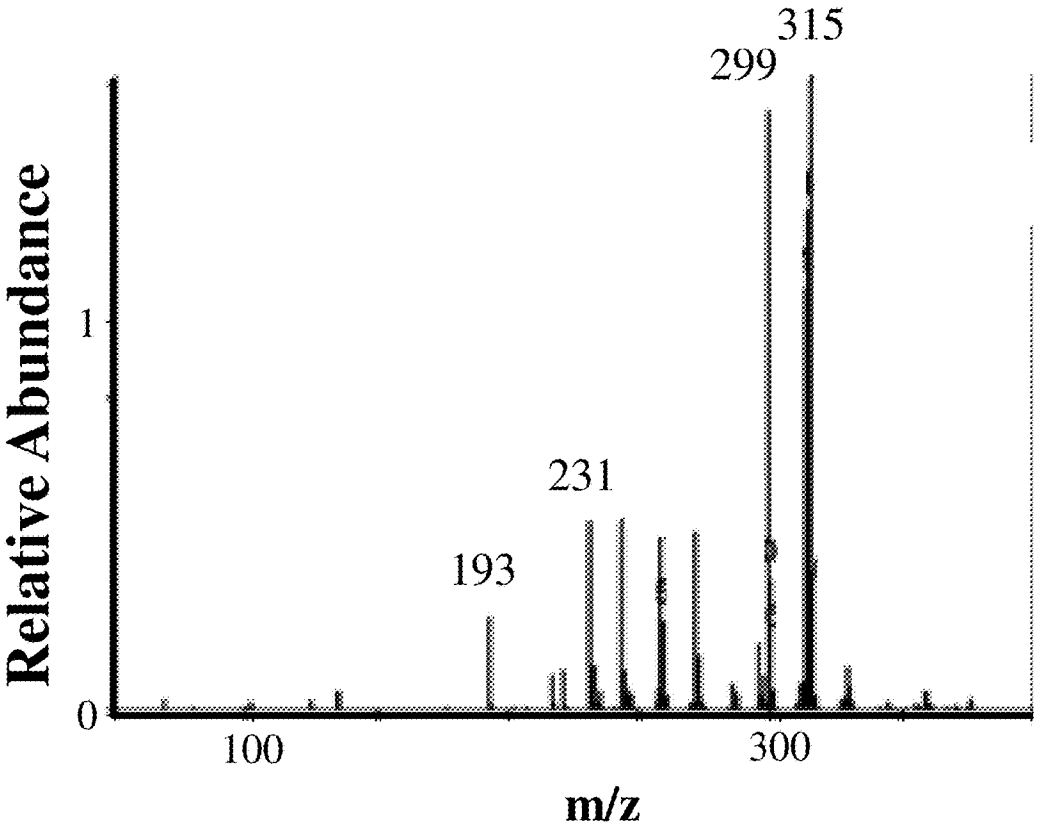
FIG. 5C shows a mass spectrum of dopant-assisted argon DART of THC with an orifice-1 voltage of 60V, according to an embodiment of the invention.

Major Ions Observed in FIG. 5C.

| Origin | Formula | Calc.[a] | m/z[b] | δ[c] | Intensity |
|---|---|---|---|---|---|
| THC | C12H17O2 | 193.12160 | 193.12285 | 1.25 | 14.760 |
| THC | C14H17O2 | 217.12151 | 217.12285 | 1.34 | 5.579 |
| THC | C14H21O2 | 221.15190 | 221.15416 | 2.26 | 6.200 |
| THC | C15H19O2 | 231.13811 | 231.13850 | 0.39 | 30.170 |
| THC | C15H21O2 | 233.15280 | 233.15416 | 1.36 | 7.011 |
| THC | C16H19O2 | 243.13921 | 243.13850 | −0.71 | 29.760 |
| THC | C17H23O2 | 259.16910 | 259.16981 | 0.71 | 14.260 |
| THC | C18H23O2 | 271.16949 | 271.16981 | 0.32 | 28.571 |
| THC | C20H23O2 | 295.16989 | 295.16981 | −0.08 | 10.560 |
| THC | C21H29O1 | 297.22000 | 297.22184 | 1.84 | 5.410 |
| THC | C20H27O2 | 299.20090 | 299.20111 | 0.21 | 95.741 |
| THC | C21H29O2 | 313.21729 | 313.21676 | −0.53 | 67.351 |
| THC | C21H30O2 | 314.22409 | 314.22458 | 0.49 | 79.769 |
| THC | C21H31O2 | 314.23239 | 315.23241 | 0.02 | 100.000 |

[a]Calculated mass;
[b]measured mass to charge;
[c]difference in millimass units.

TABLE XVI

Figure 5D:
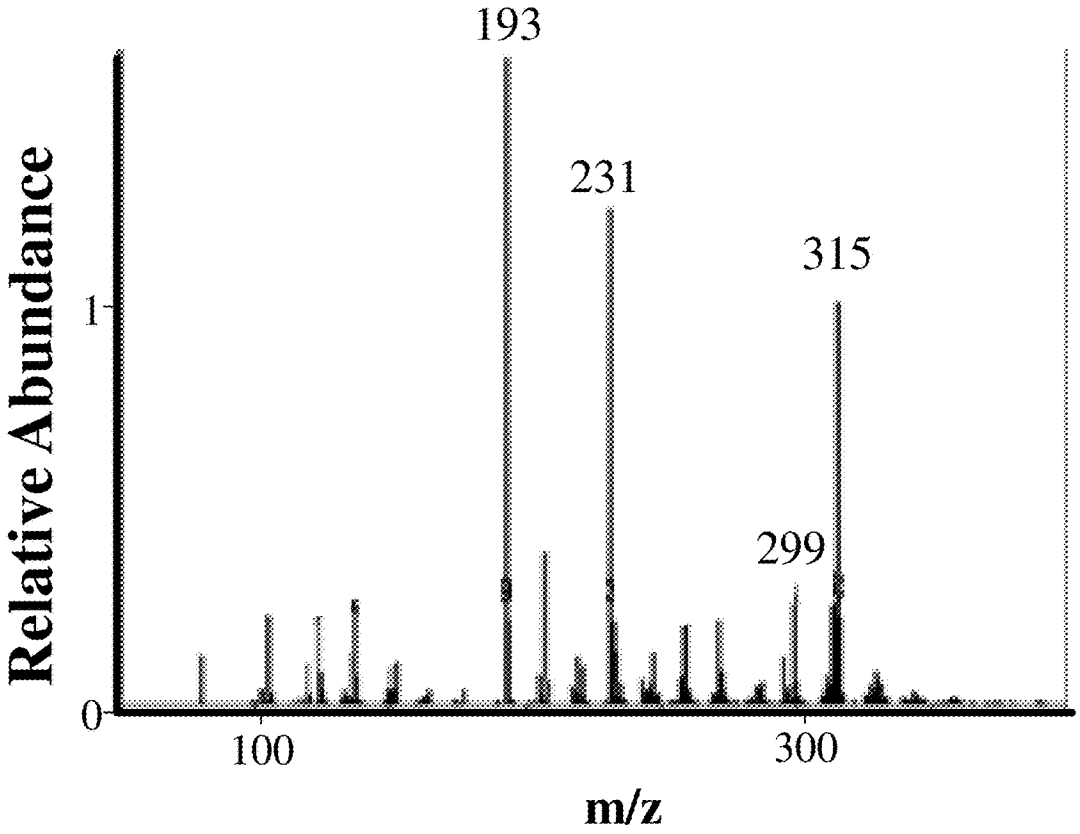
FIG. 5D shows a mass spectrum of dopant-assisted argon DART of CBD with an orifice-1 voltage of 60V, according to an embodiment of the invention.

Major Ions Observed in FIG. 5D.

| Origin | Formula | Calc.[a] | m/z[b] | δ[c] | Intensity |
|---|---|---|---|---|---|
| CBD | C12H17O2 | 193.12160 | 193.12285 | 1.25 | 100.000 |
| CBD | C14H21O2 | 221.15190 | 221.15416 | 2.26 | 5.940 |
| CBD | C15H19O2 | 231.13811 | 231.13850 | 0.39 | 76.730 |
| CBD | C15H21O2 | 233.15280 | 233.15416 | 1.36 | 8.051 |
| CBD | C17H23O2 | 259.16910 | 259.16981 | 0.71 | 12.400 |

TABLE XVI-continued

Major Ions Observed in FIG. 5D.

| Origin | Formula | Calc.[a] | m/z[b] | δ[c] | Intensity |
|---|---|---|---|---|---|
| CBD | C18H23O2 | 271.16949 | 271.16981 | 0.32 | 12.870 |
| CBD | C20H23O2 | 295.16989 | 295.16981 | −0.08 | 7.250 |
| CBD | C20H27O2 | 299.20090 | 299.20111 | 0.21 | 15.080 |
| CBD | C21H29O2 | 313.21481 | 313.21676 | 1.95 | 14.940 |
| CBD | C21H30O2 | 314.22409 | 314.22458 | 0.49 | 15.510 |
| CBD | C21H31O2 | 315.23239 | 315.23241 | 0.02 | 62.070 |

[a]Calculated mass;
[b]measured mass to charge;
[c]difference in millimass units.

TABLE XVII

Figure 5E:
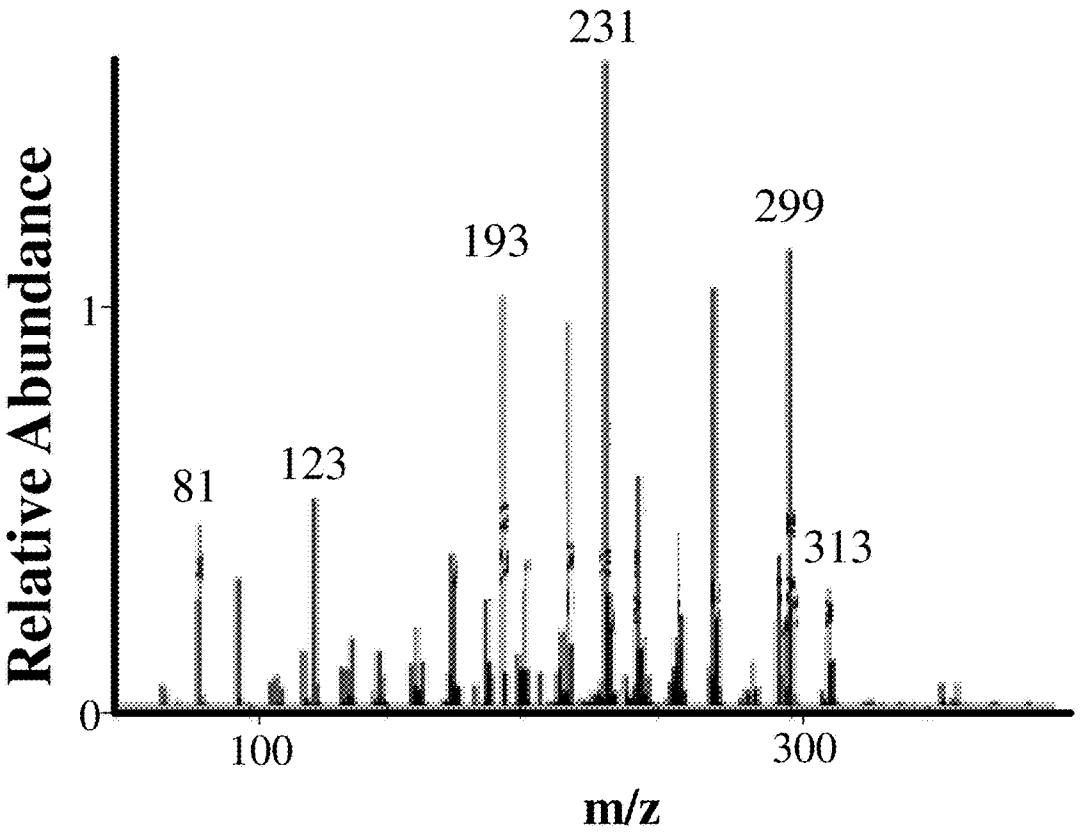
FIG. 5E shows a mass spectrum of dopant-assisted argon DART of THC with an orifice-1 voltage of 90V, according to an embodiment of the invention.

Major Ions Observed in FIG. 5E.

| Origin | Formula | Calc.[a] | m/z[b] | δ[c] | Intensity |
|---|---|---|---|---|---|
| THC | C7H11 | 95.08500 | 95.08608 | 1.08 | 19.869 |
| THC | C7H7O2 | 123.04560 | 123.04460 | −1.00 | 31.971 |
| THC | C12H11O2 | 187.07381 | 187.07590 | 2.09 | 16.879 |
| THC | C12H17O2 | 193.12160 | 193.12285 | 1.25 | 63.681 |
| THC | C13H13O2 | 201.08859 | 201.09155 | 2.96 | 24.588 |
| THC | C14H17O2 | 217.12151 | 217.12285 | 1.34 | 59.749 |
| THC | C15H19O2 | 231.13811 | 231.13850 | 0.39 | 100.000 |
| THC | C15H21O2 | 233.15280 | 233.15416 | 1.36 | 11.711 |
| THC | C16H19O2 | 243.13921 | 243.13850 | −0.71 | 37.531 |
| THC | C17H21O2 | 257.15341 | 257.15416 | 0.75 | 27.190 |
| THC | C17H23O2 | 259.16919 | 259.16981 | 0.62 | 14.252 |
| THC | C18H23O2 | 271.16949 | 271.16981 | 0.32 | 64.929 |
| THC | C20H23O2 | 295.16989 | 295.16981 | −0.08 | 23.401 |
| THC | C20H27O2 | 299.20090 | 299.20111 | 0.21 | 70.611 |
| THC | C21H29O2 | 313.21481 | 313.21676 | 1.95 | 21.920 |
| THC | C21H30O2 | 314.22141 | 314.22458 | 3.17 | 6.849 |
| THC | C21H31O2 | 315.22980 | 315.23241 | 2.61 | 7.101 |

[a]Calculated mass;
[b]measured mass to charge;
[c]difference in millimass units.

TABLE XVIII

Figure 5F:
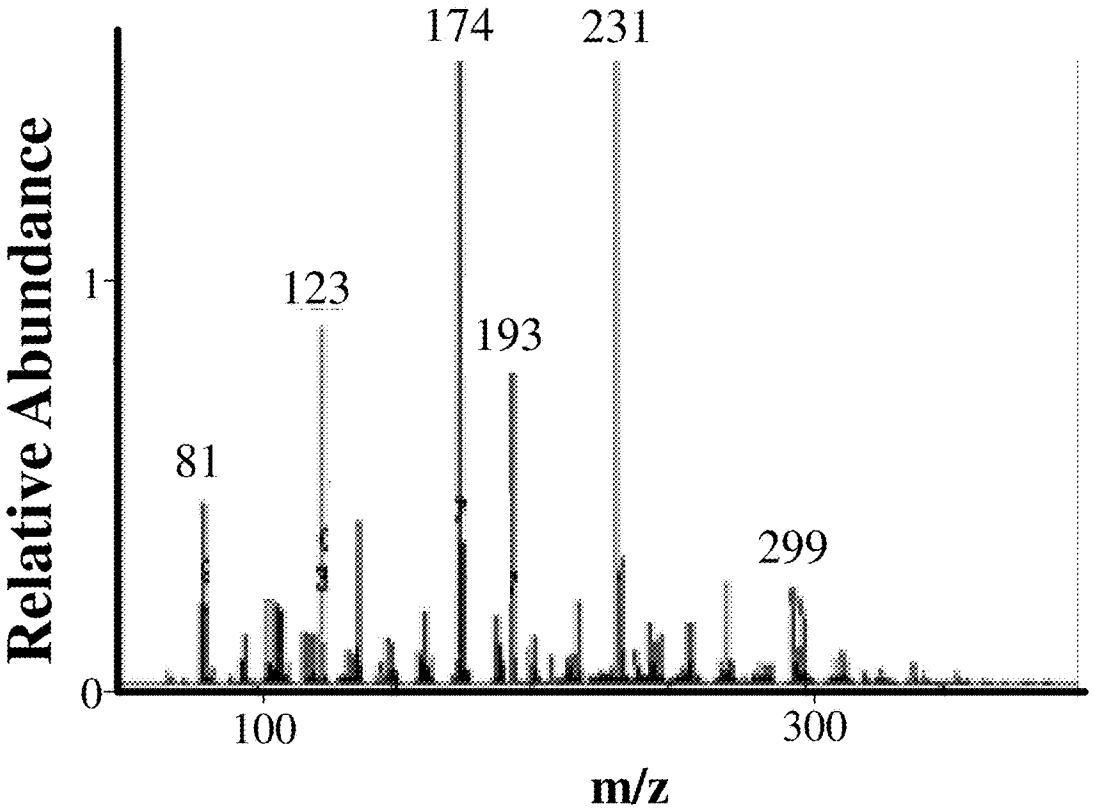
FIG. 5F shows a mass spectrum of dopant-assisted argon DART of CBD with an orifice-1 voltage of 90V, according to an embodiment of the invention.

Major Ions Observed in FIG. 5F.

| Origin | Formula | Calc.[a] | m/z[b] | δ[c] | Intensity |
|---|---|---|---|---|---|
| CBD | C7H7O2 | 123.04560 | 123.04460 | −1.00 | 55.020 |
| CBD | C11H10O2 | 174.06590 | 174.06808 | 2.18 | 100.000 |
| CBD | C12H11O2 | 187.07381 | 187.07590 | 2.09 | 10.439 |
| CBD | C12H17O2 | 193.12160 | 193.12285 | 1.25 | 48.171 |
| CBD | C13H13O2 | 201.08859 | 201.09155 | 2.96 | 7.301 |
| CBD | C14H17O2 | 217.12360 | 217.12285 | −0.75 | 12.661 |
| CBD | C15H19O2 | 231.13811 | 231.13850 | 0.39 | 99.980 |
| CBD | C16H19O2 | 243.13921 | 243.13850 | −0.71 | 9.860 |
| CBD | C17H21O2 | 257.15341 | 257.15416 | 0.75 | 9.689 |
| CBD | C17H23O2 | 259.16919 | 259.16981 | 0.62 | 10.171 |
| CBD | C18H23O2 | 271.17181 | 271.16981 | −2.00 | 15.912 |
| CBD | C20H23O2 | 295.16989 | 295.16981 | −0.08 | 15.039 |
| CBD | C20H27O2 | 299.20090 | 299.20111 | 0.21 | 10.059 |

[a]Calculated mass;
[b]measured mass to charge;
[c]difference in millimass units.

In an embodiment of the present invention, a system comprises a conventional DART source to generate a carrier gas stream contacting a sample to generate a first plurality of ions of the sample, an dopant DART source to generate a dopant carrier gas contacting the sample; a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the conventional DART source and the dopant DART source simultaneously generate ions of the sample.

In an embodiment of the present invention, a system comprises a conventional DART source to generate a carrier gas stream contacting a sample to generate a first plurality of ions of the sample, an dopant DART source to generate a dopant carrier gas contacting the sample; a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the dopant DART source comprises a conventional DART source adapted to generate an Ar* containing carrier gas.

In an embodiment of the present invention, a system comprises a conventional DART source to generate a carrier gas stream contacting a sample to generate a first plurality of ions of the sample, an dopant DART source to generate a dopant carrier gas contacting the sample; a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the efficient dopant is one or more compounds selected from the group consisting of anisole, toluene, acetone, chlorobenzene, bromobenzene, 2, 4-difluoroanisole, and 3-(trifluoromethyl) anisole.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the efficient dopant is selected from the group consisting of one or more compounds having an ionization energy lower than the internal energy of a metastable species formed by the dopant DART source.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the efficient dopant is selected from the group consisting of one or more compounds having an ionization energy lower than the internal energy of a metastable species formed by the dopant DART source, where the metastable argon species is capable of one or both charge exchange and proton transfer to one or more of the plurality of analytes.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the first plurality of ions include a negative ion.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the first plurality of ions include a negative ion, where the mass spectrometer system measures one or more fragment ions formed from the first plurality of ions.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the mass spectrometer system measures one or more fragment ions formed from ion activation of the first plurality of ions.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the mass spectrometer system measures one or more fragment ions formed from ion activation of the first plurality of ions, where the one or more fragment ions are formed from one or more methods selected from the group consisting of collisionally activated dissociation, collision induced dissociation, in source fragmentation, ion surface collisions, ion induced dissociation, photodissociation, ion neutral collisions, ion electron collisions, ion electron collisions, electron capture dissociation and function switching.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the mass spectrometer system measures one or more fragment ions formed from ion activation of the first plurality of ions, where the one or more fragment ions are generated by function switching with an orifice-1 voltage set between a lower limit of approximately 10 V and an upper limit of approximately 250 V.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, and a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, where the mass spectrometer system measures one or more fragment ions formed from ion activation of the first plurality of ions, where the one or more fragment ions are generated by function with an orifice-1 voltage set between a lower limit of approximately 30 V and an upper limit of approximately 200 V.

In an embodiment of the present invention, a system comprises a conventional DART source to generate a carrier gas stream contacting a sample to generate a first plurality of ions of the sample, an dopant DART source to generate a dopant carrier gas contacting the sample, a dopant DART source to generate a second carrier gas stream contacting the sample, a valve for introducing a dopant into the second carrier gas stream contacting the sample to generate a second plurality of ions of the sample, a mass spectrometer system for measuring two or more of a mass spectrum of the first plurality of ions, one or more fragment ions formed from the first plurality of ions, a mass spectrum of the second plurality of ions and one or more fragment ions formed from the second plurality of ions, and a gas ion separator.

In an embodiment of the present invention, a method comprises directing a first carrier gas from a conventional DART source at a sample to form positive ions of the sample or negative ions of the sample, measuring positive ions of the sample or negative ions of the sample, introducing a dopant, generating a plurality of dopant ions from the interaction of the dopant with a second carrier gas formed from a dopant DART source, directing the plurality of dopant ions at the sample to form a plurality of intact ions of the sample, measuring a plurality of intact ions of the sample, and determining one or more chemical features of the sample based on the positive ions of the sample or negative ions of the sample and the plurality of intact ions of the sample.

While the systems, methods, and devices have been illustrated by the described examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and devices provided herein. Additional advantages and modifications will readily be apparent to those skilled in the art. Therefore, the invention, in its broader aspects, is not limited to the specific details, the representative system, method or device, and illustrative examples shown and described. Accordingly, departures may be made from such details without departing from the spirit or scope of the applicant's general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents. In any multiply tuned circuit you have at least as many modes as you have inductors.

What is claimed is:

1. A method comprising:

a) directing a first metastable carrier gas from a conventional DART source at a sample to form positive ions of the sample or negative ions of the sample;

b) measuring a first mass spectrum of the positive ions or negative ions formed in step (a);

c) introducing a dopant;

d) generating a plurality of dopant ions from the interaction of the dopant with a second metastable carrier gas formed from a dopant DART source;

e) directing the plurality of dopant ions at the sample to form a plurality of intact ions of the sample;

f) measuring a second mass spectrum of the plurality of intact ions of the sample formed in step (e); and g) combining the first mass spectrum and the second mass spectrum to determine one or more chemical features of the sample.

2. The method of claim 1, where the first metastable carrier gas and the plurality of dopant ions simultaneously generate ions of the sample.

3. The method of claim 1, where the dopant DART source comprises a DART source supplied with a dopant carrier gas and adapted to interact the second metastable carrier gas with the dopant to form the plurality of dopant ions.

4. The method of claim 1, further comprising generating fragment ions of the plurality of intact ions.

5. The method of claim 1, where the dopant is one or more compounds selected from the group consisting of anisole, toluene, acetone, chlorobenzene, bromobenzene, 2, 4-difluoroanisole, and 3-(trifluoromethyl)anisole.

6. The method of claim 1, where the sample is made up of a plurality of analytes.

7. The method of claim 6, where in step (g) one or more chemical features of one or more of the plurality of analytes are determined.

8. The method of claim 6, where the dopant is suitable for one or both charge exchange and proton transfer to one or more of the plurality of analytes.

9. The method of claim 1, where the second metastable carrier gas contains excited metastable argon species (Ar*).

10. The method of claim 9, where the dopant is a compound having an ionization energy between:

a lower limit of approximately 3.5 eV; and an upper limit of approximately 11.5 eV.

11. The method of claim 9, where the dopant is a compound having an ionization energy between:

a lower limit of approximately 3.8 eV; and an upper limit of approximately 11.8 eV.

12. A device comprising:

a) an ionization region comprising a conventional DART source adapted to generate a first metastable carrier gas and a dopant DART source adapted to generate a second metastable carrier gas, where the conventional DART source is adapted to direct the first metastable carrier gas to interact with a sample to generate a first plurality of ions of the sample and the dopant DART source is adapted to direct the second metastable carrier gas to interact with the sample;

b) a reservoir introduction system containing at least one dopant;

c) a valve for introducing the at least one dopant interacting with the second metastable carrier gas to form a plurality of dopant ions which interact with the sample to generate a second plurality of ions of the sample; and d) a mass spectrometer system for measuring two or more of a mass spectrum of the first plurality of ions, one or more ions of the first plurality of ions, a mass spectrum of the second plurality of ions, and one or more ions of the second plurality of ions.

13. The device of claim 12, where the first metastable carrier gas and the plurality of dopant ions interact with the sample simultaneously.

14. The device of claim 12, where the at least one dopant is selected from the group consisting of anisole, toluene, acetone, chlorobenzene, bromobenzene, 2, 4-difluoroanisole, and 3-(trifluoromethyl)anisole.

15. The device of claim 12, where the second metastable carrier gas contains excited metastable argon species (Ar*).

16. The device of claim 15, where the at least one dopant is selected from the group consisting of compounds having an ionization energy lower than the internal energy of Ar*.

17. The device of claim 15, where the Ar* is capable of one or both charge exchange and proton transfer to molecules of the sample.

18. The device of claim 12, where the first plurality of ions include a negative ion.

19. The device of claim 18, where the mass spectrometer system is adapted to measure one or more fragment ions formed from the first plurality of ions.

20. The device of claim 12, where the mass spectrometer system measures one or more fragment ions formed from ion activation of the first plurality of ions.

21. The device of claim 12, further comprising a gas ion separator.

* * * * *